US010427853B2

(12) United States Patent
Maquita Nakano et al.

(10) Patent No.: US 10,427,853 B2
(45) Date of Patent: Oct. 1, 2019

(54) CONTAINER WITH PRESSURE ACCOMMODATION AREA

(71) Applicant: PepsiCo, Inc., Purchase, NY (US)

(72) Inventors: Jorge Manuel Maquita Nakano, Distrito Federal (MX); Lori Evans Bartman, Sylvania, OH (US)

(73) Assignee: PepsiCo, Inc., Purchase, NY (US)

( * ) Notice: Subject to any disclaimer, the term of this patent is extended or adjusted under 35 U.S.C. 154(b) by 67 days.

(21) Appl. No.: 15/259,582

(22) Filed: Sep. 8, 2016

(65) Prior Publication Data

US 2017/0073137 A1 Mar. 16, 2017

Related U.S. Application Data

(60) Provisional application No. 62/216,876, filed on Sep. 10, 2015.

(51) Int. Cl.
*B65D 1/02* (2006.01)
*B65D 79/00* (2006.01)

(52) U.S. Cl.
CPC ..... *B65D 79/005* (2013.01); *B65D 1/0223* (2013.01)

(58) Field of Classification Search
CPC ... B65D 1/02; B65D 1/40; B65D 1/42; B65D 1/44; B65D 1/0223; B65D 2501/0036; B65D 2501/0081; B65D 79/005; Y10S 215/90
See application file for complete search history.

(56) References Cited

U.S. PATENT DOCUMENTS

| | | | | |
|---|---|---|---|---|
| 5,971,184 | A | 10/1999 | Krishnakumar et al. | |
| 7,694,842 | B2 | 4/2010 | Melrose | |
| 8,529,975 | B2 | 9/2013 | Trude et al. | |
| 8,556,097 | B2 | 10/2013 | Mast et al. | |
| 8,616,395 | B2 | 12/2013 | Patcheak et al. | |
| 2001/0035392 | A1* | 11/2001 | Ota | B65D 1/0223 215/381 |
| 2006/0070977 | A1 | 4/2006 | Howell et al. | |
| 2008/0257856 | A1 | 10/2008 | Melrose et al. | |
| 2010/0206837 | A1 | 8/2010 | Deemer et al. | |
| 2011/0220668 | A1 | 9/2011 | Steih et al. | |
| 2012/0219738 | A1* | 8/2012 | Boukobza | B65D 1/0223 428/35.7 |

OTHER PUBLICATIONS

Written Opinion of the International Searching authority in corresponding PCT Application, International Application No. PCT/US2016/048644, dated Oct. 28, 2016. (3 pages).

* cited by examiner

*Primary Examiner* — Stephen J Castellano
(74) *Attorney, Agent, or Firm* — Sterne, Kessler, Goldstein & Fox P.L.L.C.

(57) ABSTRACT

A container comprising a body portion is provided. The body portion includes a flat upper vacuum panel, a flat lower vacuum panel, and a recess between the flat upper vacuum panel and the flat lower vacuum panel. In response to a change in the internal container pressure, the body portion flexes at the recess towards an interior of the container and the flat upper vacuum panel and the flat lower vacuum panel form a progressively smaller angle at the recess in response to an increasing pressure change.

22 Claims, 21 Drawing Sheets

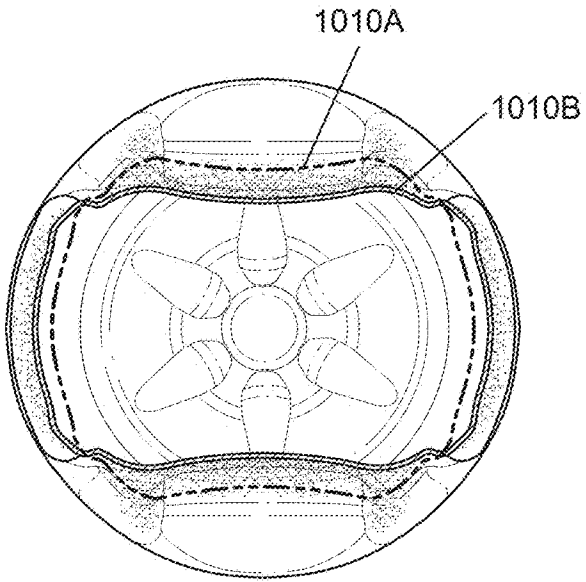
FIG. 12D
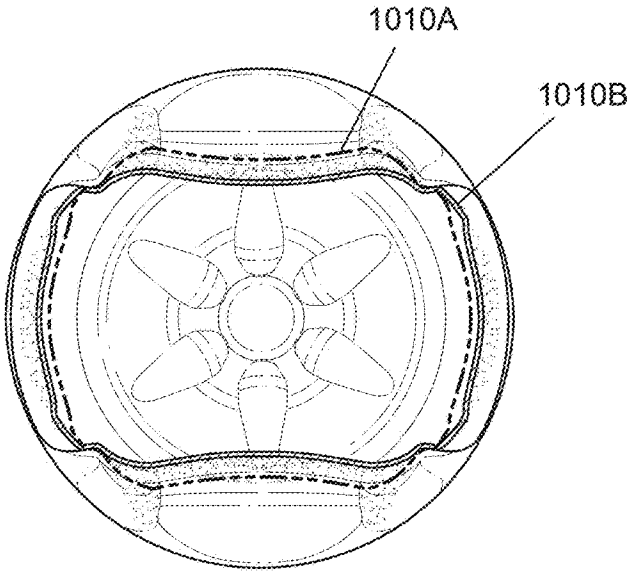
FIG. 12C
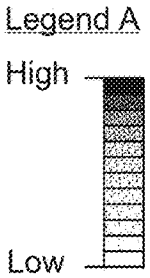

CONTAINER WITH PRESSURE ACCOMMODATION AREA

CROSS-REFERENCE TO RELATED APPLICATIONS

The present application claims priority to U.S. Provisional Patent Application No. 62/216,876 filed on Sep. 10, 2015, which is incorporated herein in its entirety by reference thereto.

BACKGROUND

Field of the Invention

The present disclosure relates to containers.

BRIEF SUMMARY

In some embodiments, a container comprising a body portion is provided. The body portion includes a flat upper vacuum panel, a flat lower vacuum panel, and a recess between the flat upper vacuum panel and the flat lower vacuum panel. In response to a change in the internal container pressure, the body portion flexes at the recess towards an interior of the container and the flat upper vacuum panel and the flat lower vacuum panel form a progressively smaller angle at the recess in response to an increasing pressure change.

In some embodiments, the recess is a living hinge that connects the flat lower vacuum panel and the flat upper vacuum panel. In some embodiments, the hinge comprises two connecting sidewalls forming an angle, wherein the angle decreases as the hinge flexes. In an embodiment, the flat upper vacuum panel and the flat lower vacuum panel flex in towards the interior of the container after the flexing of the hinge.

In some embodiments, the flat upper vacuum panel and the flat lower vacuum panel are co-planar prior to flexing and move out of plane to form the progressively smaller angle at the hinge.

In some embodiments, the flat upper vacuum panel and the flat lower vacuum panel together have a height that is at least 30% of a total height of the container.

In some embodiments, at least one of the flat upper vacuum panel and the flat lower vacuum panel has a height that is at least 15% of a total height of the container.

In some embodiments, wherein the container has an initial volume, and flexing of the hinge, the flat upper vacuum panel, and the flat lower vacuum panel decreases the initial volume by 3%. In some embodiments, the flexing of the hinge, the flat upper vacuum panel, and the flat lower vacuum panel decreases the initial volume by 5%.

In some embodiments, the flat upper vacuum panel and the flat lower vacuum panel remain flat while flexing.

In some embodiments, the recess comprises a valley with an angled sidewall.

In some embodiments, the body portion has an oval cross-section.

In some embodiments, the container further comprises a neck portion with a cross-sectional circumference, a shoulder portion with a cross-sectional circumference, and a base portion with a cross-sectional circumference. The shoulder portion is connected to the neck portion and the body portion extends from the shoulder portion to the base portion. The shoulder portion is also connected to the neck portion. In some embodiments, the shape of the cross-sectional circumference of the body portion at the recess changes more relative to the other cross-sectional circumferences in response to the increasing pressure change.

In some embodiments, the shoulder portion has a cross-sectional circumference that is greater than a cross-sectional circumference of the body portion.

In some embodiments, the flat upper vacuum panel and the flat lower vacuum panel are co-planar before flexion.

In some embodiments, the body portion further comprises a scalloped region extending circumferentially adjacent to the upper vacuum panel, the lower vacuum panel, and the recess. In some embodiments, the scalloped region flexes outwardly in response to the change in internal container pressure.

In some embodiments, the container is a bottle.

In some embodiments a container is provided. The container comprises a neck portion defining a container opening, a shoulder portion connected to the neck portion, and a body portion extending from the shoulder portion to a base portion. The body portion comprises two pressure accommodation areas and two vertical ribbed areas. Each pressure accommodation area includes a first flat panel, a second flat panel, and a groove connecting the first flat panel and the second flat panel. The groove of each pressure accommodation area moves in towards an interior of the body in response to a change in pressure within the container.

In some embodiments, the body portion has an oval cross-section and the groove of one pressure accommodation area is disposed diametrically opposite the groove of the other pressure accommodation area.

In some embodiments, the pressure change is caused by a cooling of a liquid contained within the container.

In some embodiments, the pressure change is caused by a pressure applied to an exterior of the container.

In some embodiments, the container includes no more than two of the pressure accommodation areas.

In some embodiments, a container for storing a liquid filled in a hot state and then sealed is provided. The container comprises a neck portion defining a container opening, a shoulder portion connected to the neck portion, and pressure accommodation area coupled to the shoulder portion, wherein the pressure accommodation area comprises a flat area horizontally bisected by a valley. When the container is sealed, the pressure accommodation area is configured to flex away from its original shape towards an interior of the container, and when the seal is released, the pressure accommodation area is configured to return to its original shape.

In some embodiments, the flex is initiated by cooling of the liquid.

BRIEF DESCRIPTION OF THE DRAWINGS/FIGURES

FIG. 12C shows changes to the cross-sectional view of FIG. 12A while flexing.

FIG. 12D shows changes to the cross-sectional view of FIG. 12A while flexing.

Figure 14A:
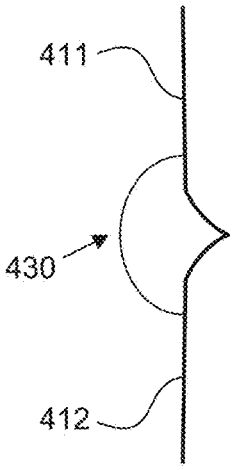
Figure 14B:
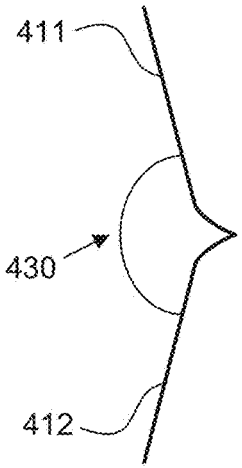
Figure 14C:
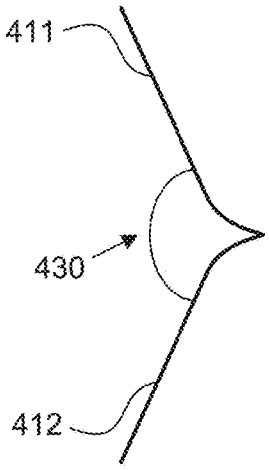

FIG. 14A, FIG. 14B, and FIG. 14C show representations of the angle change between a first vacuum panel and a second vacuum panel according to some embodiments.

Figure 15A:
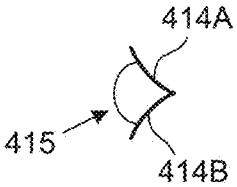
Figure 15B:
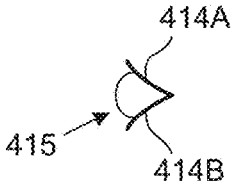
Figure 15C:
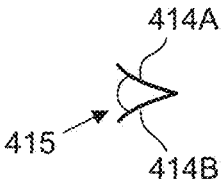

FIG. 15A, FIG. 15B, and FIG. 15C show representations of the angle change at a hinge according to some embodiments.

DETAILED DESCRIPTION

Drinkable fluids provided to consumers, such as juices, soft drinks, and sports drinks, may be bottled using a hot-fill process. With this process, the liquid is heated to an elevated temperature and then bottled while at that elevated temperature. Specific heating temperatures vary depending on the liquid being bottled and the type of container being used for bottling. For example, when bottling a liquid for a sports drink using a container made of PET, the liquid may be heated to a temperature of 83° C. or higher. The elevated liquid temperature of the liquid sterilizes the container upon filling such that other sterilization processes are not needed. After the liquid is filled, the container is immediately capped, sealing the hot liquid inside the container. The container, along with the liquid inside, is then actively cooled before the container is labeled, packaged, and shipped to the consumer.

Despite the benefits of the hot-fill process, the cooling down of the liquid after filling may cause deformation of the container and stability issues. For example, a liquid that is heated to 83° C. may be cooled down to 24° C. for the labeling, packaging, and shipping process. The cooling of the hot liquid reduces the volume of the liquid inside the container. Because the container is sealed, the volume reduction of the liquid results in a change in the container's internal pressure such that the pressure inside the container becomes lower than the pressure surrounding the container. For example, the pressure inside the container may change such that it is 1-550 mm Hg less than the pressure surrounding the container (atmospheric pressure).

As the internal pressure in the container drops, it creates a pressure differential (vacuum) that causes stresses to the container. If left uncontrolled, these stresses may result in undesirable distortion of the container shape as the container and contents tend toward an equilibrium state. For example, the container may distort significantly from its original shape so that it is difficult to label or package the container.

Thus, there exists a need for a container that may accommodate this internal pressure change during the bottling process so the container does not drastically deform from its original shape. Additionally, the container should be able to accommodate this change in internal pressure in a way that does not interfere with the stability and usability of the container. For example, the container, in its deformed shape, should still be able to withstand forces that may be experienced during shipment. Additionally, the accommodation method should not interfere with a consumer's use of the container, such as when the consumer dispenses the liquid from the container.

Containers as described herein comprise at least one pressure accommodation area. The pressure accommodation area has a first vacuum panel, a second vacuum panel, and a recess between the first vacuum panel and the second vacuum panel. Due to the shape of the panels, the shape of the recess, and the connection between the panels and the recess, the pressure accommodation area may safely accommodate a change in the internal pressure of the container without causing uncontrollable distortion. Additionally, the pressure accommodation area disclosed herein does not interfere with the container's usability. In some embodiments, the pressure accommodation area contributes to the usability of the container.

Figure 1:
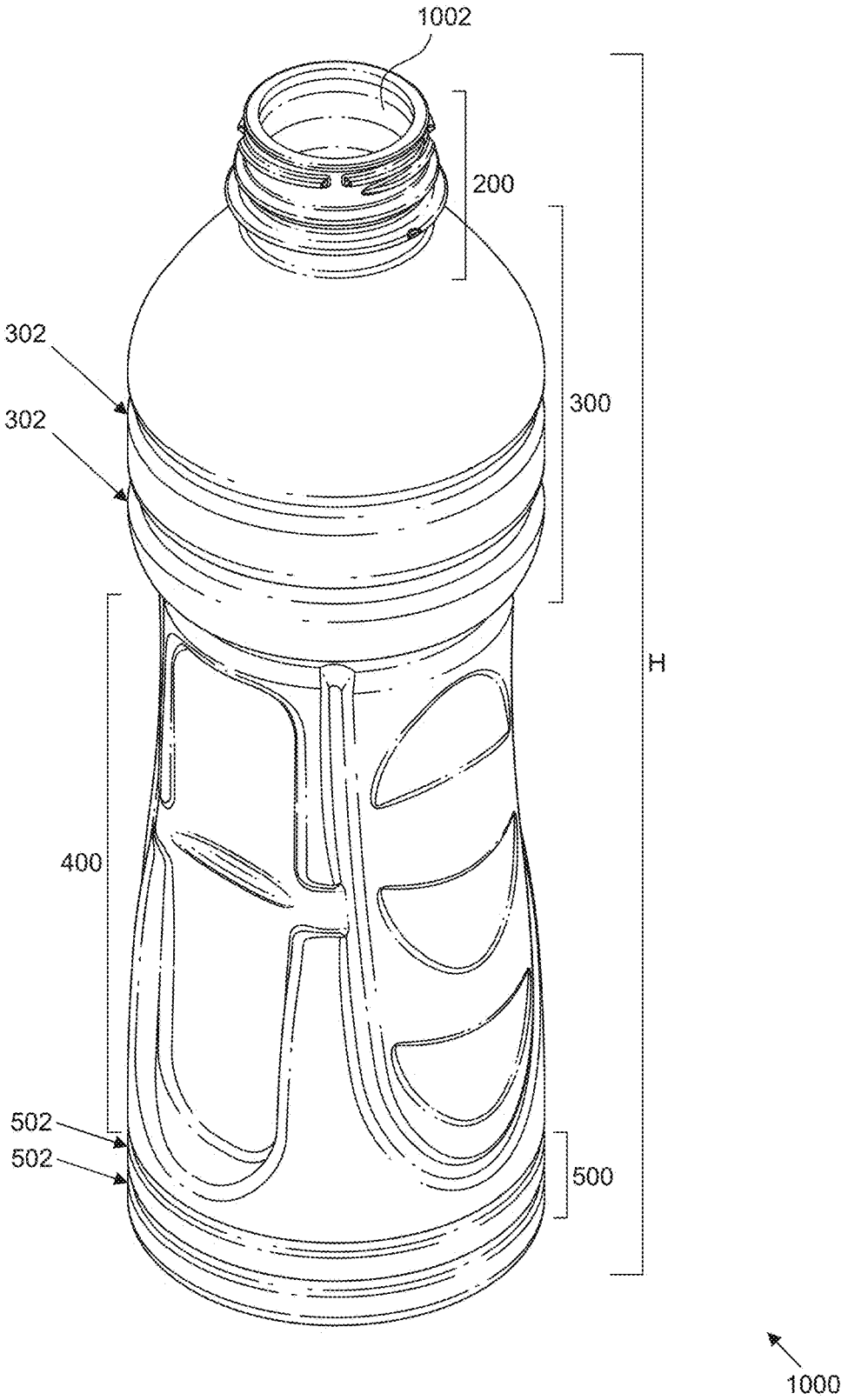
FIG. 1 is a perspective top view of a container according to some embodiments.

In some embodiments, and as shown in FIG. 1, a container 1000 has a neck portion 200, a shoulder portion 300, a body portion 400, and a base portion 500. A container opening 1002 allows for liquid to flow in and out of container 1000. Container 1000 may also include a lid 600, shown in FIG. 11B, which is placed over the neck portion 200 after the container is filled to seal the container from the outside environment. Lid 600 may be removed from the neck portion 200 in order to access the liquid.

Figure 6A:
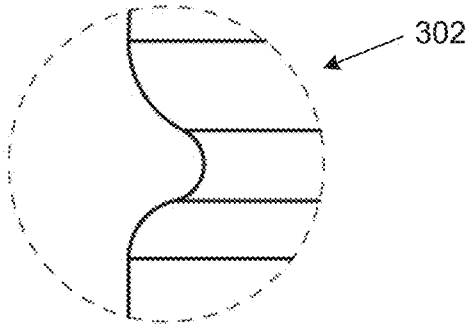
FIG. 6A is a close-up view of area A in the container of FIG. 5.
Figure 6B:
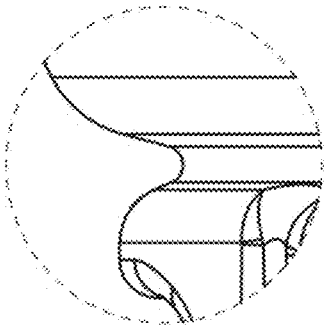
FIG. 6B is a close-up view of area B in the container of FIG. 5.

FIG. 6B shows an up-close view of the transition between the shoulder portion 300 and the body portion 400. In some embodiments, shoulder portion 300 is greater in circumference than body portion 400 and a horizontal cross-section of shoulder portion 300 encloses a greater area than does a horizontal cross-section of body portion 400.

Container 1000 may be any vessel that is suitable for storing a liquid, in which, during storage, the internal pressure of container 1000 changes. In some embodiments, container 1000 is a bottle. In some embodiments, container 1000 is made of PET (polyethylene terephthalate), but other suitable flexible and resilient materials may be used, including, but not limited to, plastics such as PEN (polyethylene naphthalate), bioplastics such as PEF (polyethylene fluranoate), and other polyesters.

Figure 6C:
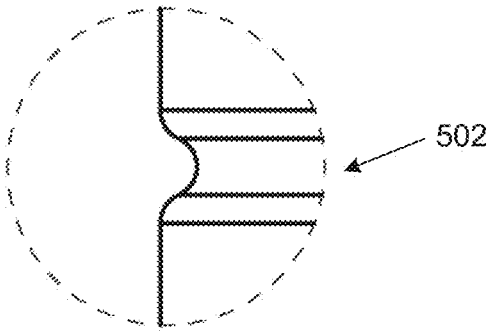
FIG. 6C is a close-up of area C in the container of FIG. 5.
Figure 7:
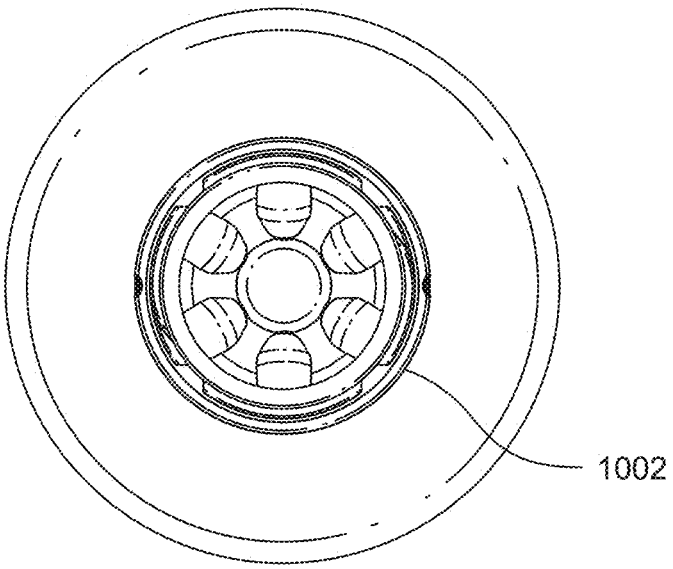
FIG. 7 is a top view of a container according to some embodiments.

Container 1000 has a height H that is measured from the beginning of the neck portion 200 to the end of the base portion 500. Sections 302 of shoulder portion 300 and sections 502 of base portion 500 are ridged, with the ridges extending around the entire circumference of those sections. FIG. 6A and FIG. 6C show close-up views of ridged sections 302 and 502, respectively.

Figure 2:
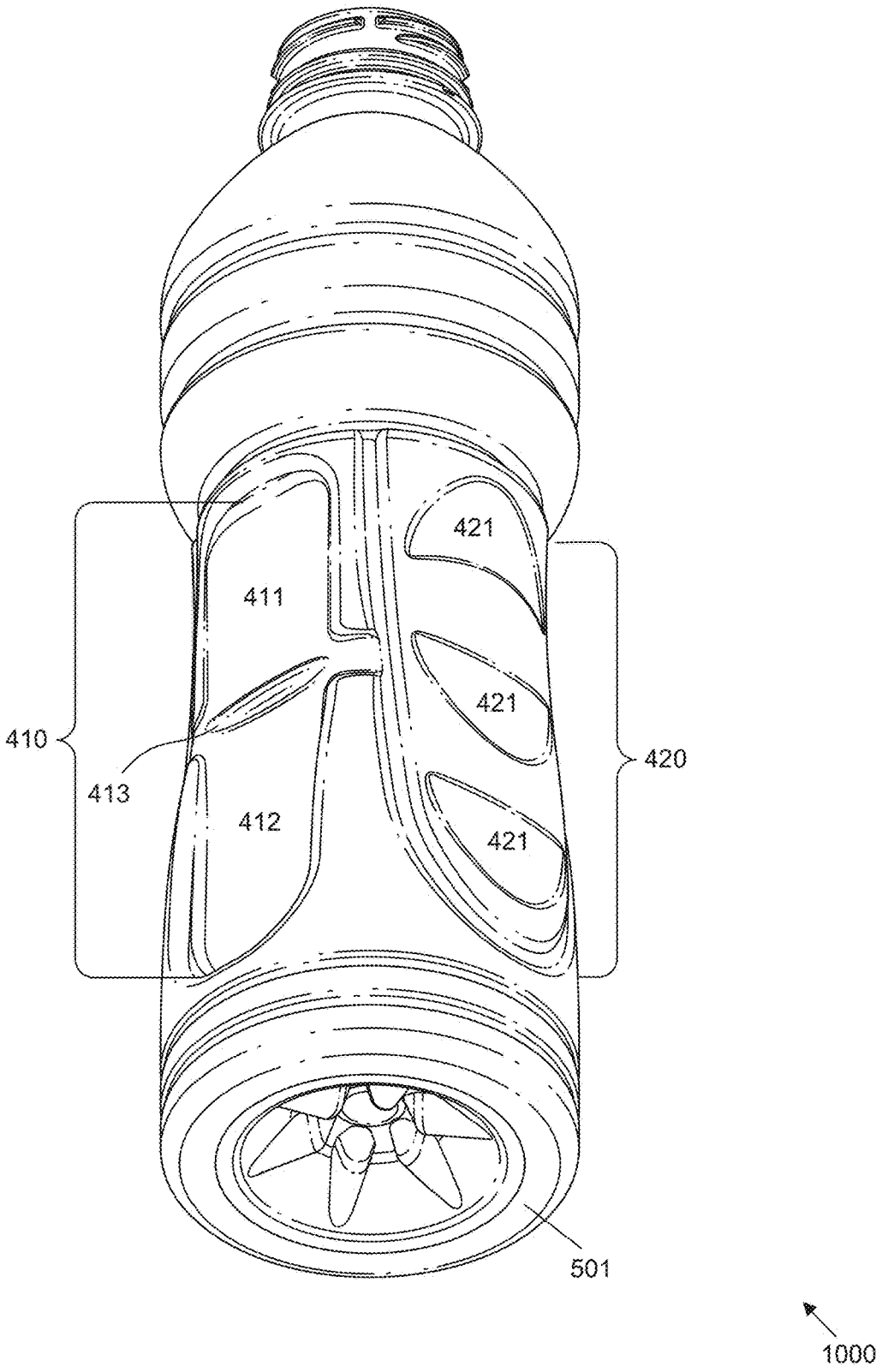
FIG. 2 is a perspective bottom view of a container according to some embodiments.
Figure 3:
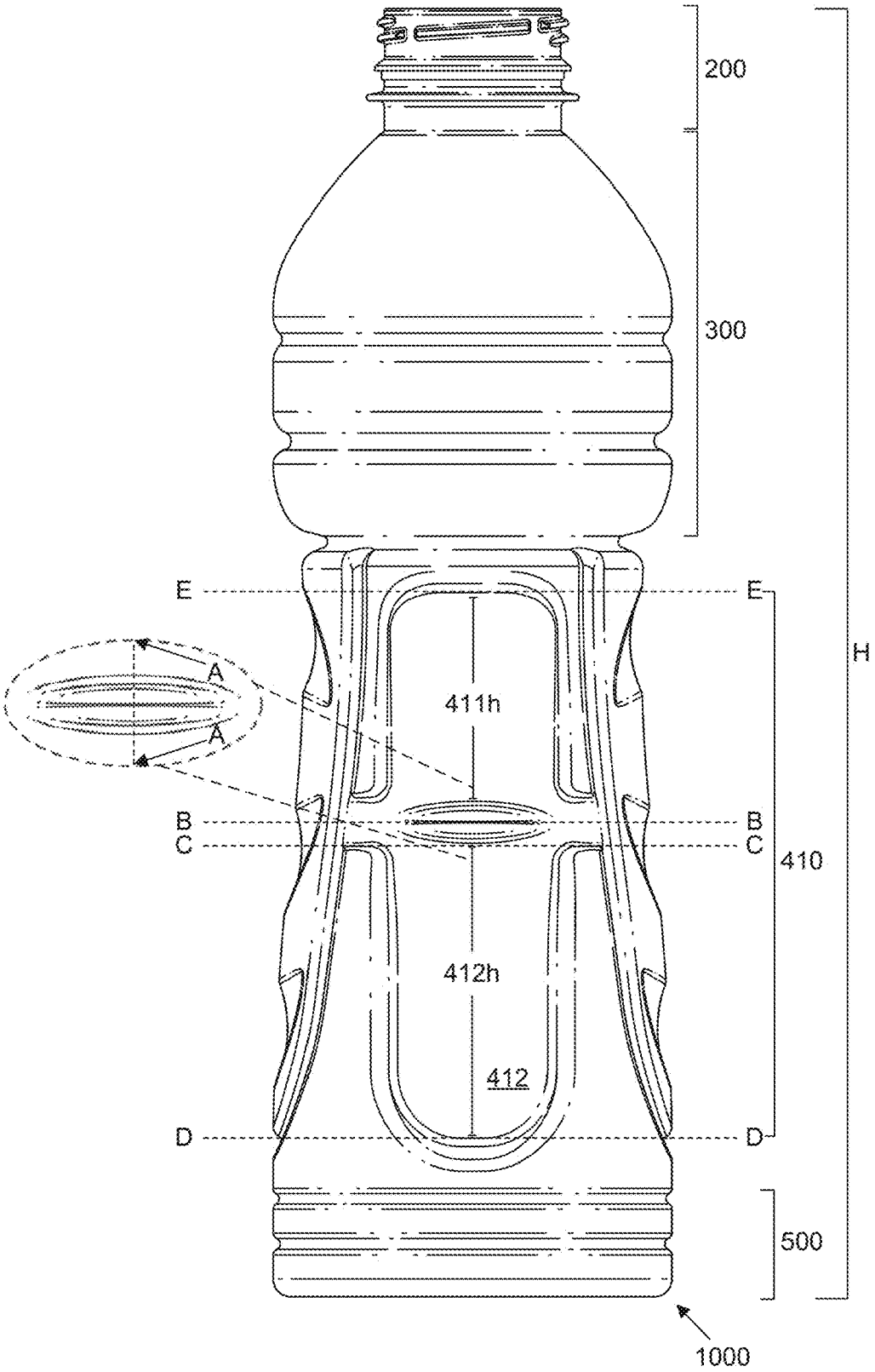
FIG. 3 is side view of a container with a pressure accommodation area according to some embodiments.

Referring now to FIG. 2 and FIG. 3, body portion 400 of container 1000 includes at least one pressure accommodation area 410 that is set back (recessed) from the rest of the body portion 400. Pressure accommodation area 410 controls the deformation of container 1000 during the hot-fill process such that the container maintains its stability and does not deform drastically.

Pressure accommodation area 410 includes a first vacuum panel 411, a second vacuum panel 412, and a recess 413 located between the first and second vacuum panels 411 and 412. FIGS. 2 and 3 show the first vacuum panel 411, the second vacuum panel 412, and the recess 413 arranged such that the first vacuum panel 411 is directly above the second vacuum panel 412 with the recess 413 extending horizontally between the two vacuum panels 411 and 412. As will be described in further detail below, this arrangement initiates and contributes to the flexing of the first vacuum panel 411 and the second vacuum panel 412. However, other arrangements are also envisioned so long as the concepts of the flexing of the first vacuum panel 411, the second vacuum panel 412, and the recess 413 as described herein may be achieved. For example, in some embodiments, the recess 413 may extend horizontally for only a portion of the width of the first vacuum panel 411 and the second vacuum panel 412 and not the entire width. In another embodiment, first vacuum panel 411 may not be directly above second vacuum panel 412, but may be horizontally offset from second vacuum panel 412.

In some embodiments, at least one of first vacuum panel 411 and second vacuum panel 412 is flat. In some embodiments, both first vacuum panel 411 and second vacuum panel 412 are flat. Such flat surfaces may allow for less stress resistance as compared to other surfaces, such as ridged or curved surfaces, thereby promoting deformation of these flat surfaces upon an internal volume change.

In some embodiments, and as shown in FIG. 3, second vacuum panel 412 has a height 412*h* that is taller than a height 411*h* of the first vacuum panel 411. While FIG. 3 shows height 412*h* as being greater than height 411*h*, height 411*h* could be greater than height 412*h* or both heights 411*h* and 412*h* could be equal. In some embodiments, 412*h* and 411*h* together have a height that accounts for at least 30% of container 1000's height H. In some embodiments 412*h* and 411*h* together have a height that accounts for at least 50% of container 1000's height H. In some embodiments, either height 411*h* or 412*h* by itself makes up at least 15% of total height H of container 1000. In some embodiments, either height 411*h* or 412*h* by itself makes up at least 20% of the total height H of container 1000. Thus, in some embodiments, a pair of first vacuum panel 411 and second vacuum panel 412 are prominent features of container 1000 and account for a substantial portion of the surface area of container 1000 (e.g., greater than 5% or greater than 10%).

Figure 5:
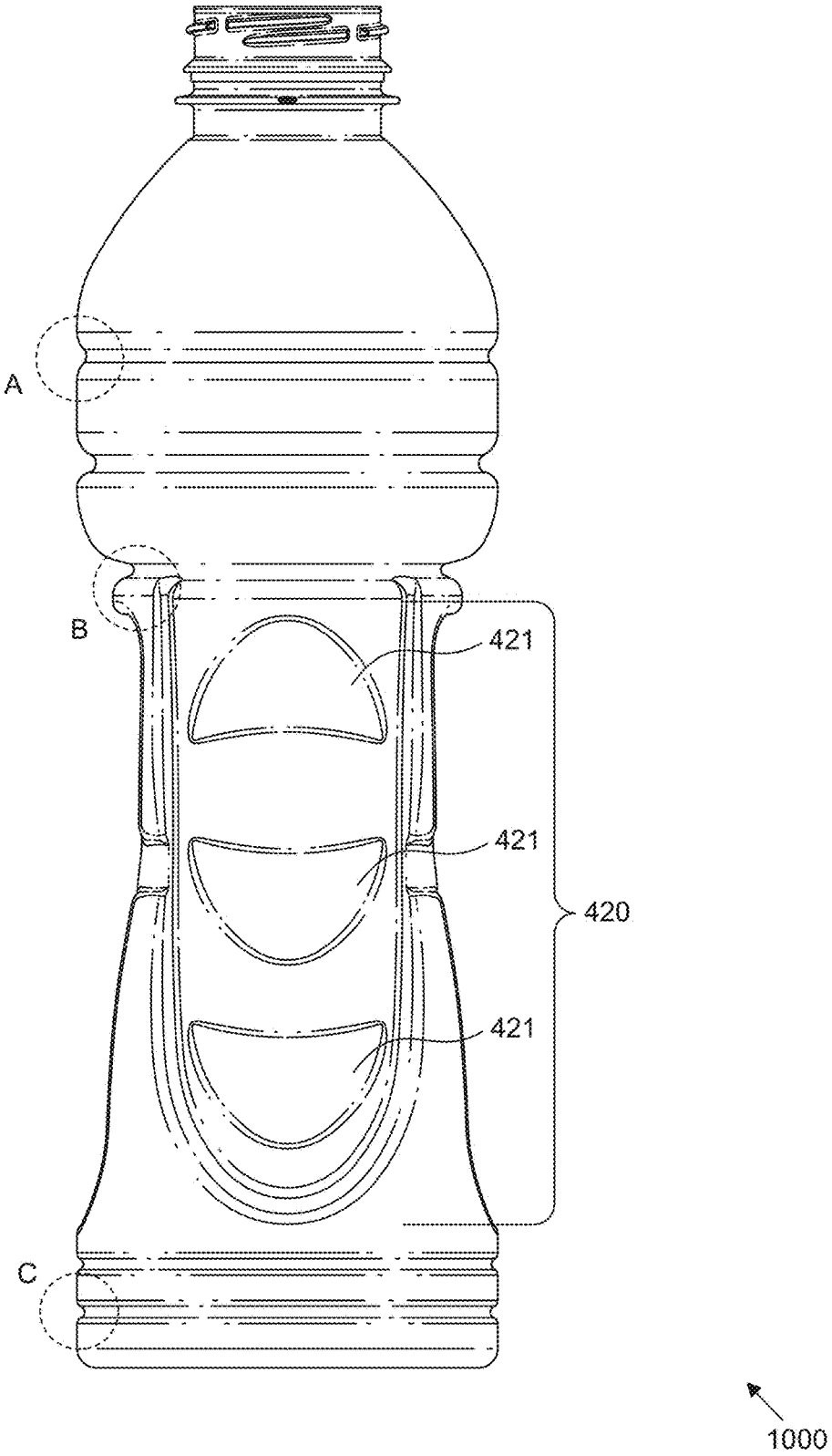
FIG. 5 is a side view of a container with a vertical ribbed area according to some embodiments.

Body portion 400 of container 1000 may also include a vertical ribbed area 420. An embodiment of vertical ribbed area 420 is shown in FIGS. 2 and 5. As shown in FIG. 2, vertical ribbed area 420 may be circumferentially adjacent to pressure accommodation area 410, extending circumferentially adjacent to first vacuum panel 411, second vacuum panel 412, and recess 413. Referring back to FIG. 5, in some embodiments, vertical ribbed area 420 may include at least one scalloped feature 421. While FIG. 2 shows three scalloped features 421, container 1000 may include more or fewer scalloped features. Vertical ribbed area 420, along with the scalloped features 421, contributes to stability of the container during packaging and provides a grip area for the consumer. In some embodiments, vertical ribbed area 420 does not flex in towards the interior of container 1000 when container 1000 deforms.

Container 1000 may have more than one pressure accommodation area 410 and more than one vertical ribbed area 420. As shown in the Figures, in some embodiments container 1000 may have two pressure accommodation areas 410 and two vertical ribbed areas 420. In embodiments with two pressure accommodation areas 410, the second pressure accommodation area 410 is similar to the first pressure accommodation area 410. In embodiments with two vertical ribbed areas 420, the second vertical ribbed area 420 is similar to the first vertical ribbed area 420.

In embodiments with two vertical ribbed areas 420 and two pressure accommodation areas 410, the four areas may be located in container 1000 anywhere circumferentially. For example, in some embodiments second pressure accommodation area 410 is positioned diametrically opposite first pressure accommodation area 410 and first vertical ribbed area 420 is positioned diametrically opposite second vertical ribbed area 420. This is shown, for example, in FIGS. 11A and 12A. This arrangement of two diametrically opposed pressure accommodation areas 410 and two diametrically opposed vertical ribbed areas 420 provide container 1000 with symmetrical deflection sides so that container 1000 may deform in a uniform and aesthetically pleasing manner. As will be described later, this arrangement also allows container 1000, and more specifically, the horizontal cross-section of container 1000 at recess 413, to retain its generally oval shape throughout deformation due to the similar way the two diametrically opposed pressure accommodation areas 410 change in response to the change in internal pressure. In some embodiments, container 1000 has no more than two vertical ribbed areas 420. In some embodiments, container 1000 has no more than two pressure accommodation areas 410.

In some embodiments container 1000 may include more than two pressure accommodation areas 410 and more than two vertical ribbed areas 420. A person of ordinary skill in the art, with the benefit of this disclosure, could determine an appropriate number of pressure accommodation areas 410 and vertical ribbed areas 420 and suitable placement of each depending on bottle shape and design.

FIGS. 4A-4E show different cross-sections of container 1000 before deformation of container 1000.

Figure 4A:
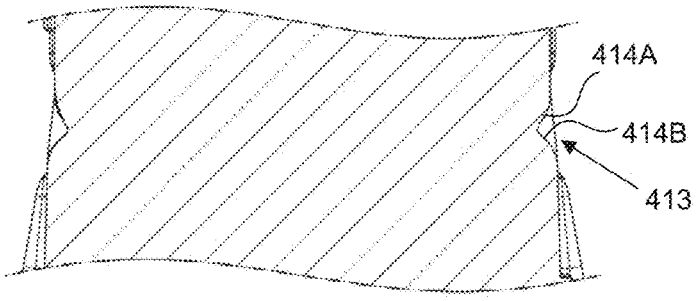
FIG. 4A is a cross-sectional view of the container of FIG. 3 at line A-A.

FIG. 4A is a vertical cross-section of pressure accommodation area 410 along line A-A of FIG. 3. As shown in FIG. 4A, in some embodiments, recess 413 takes the shape of a valley with two angled sidewalls 414A and 414B. FIG. 4A also details a portion of first vacuum panel 411 and second vacuum panel 412. In FIG. 4A, these vacuum panels are flat.

Figure 4B:
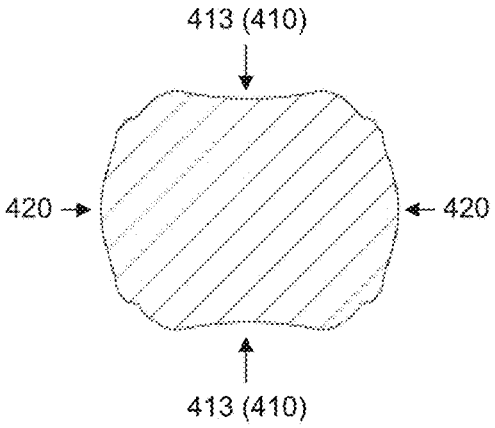
FIG. 4B is a cross-sectional view of the container of FIG. 3 at line B-B.

FIG. 4B is a horizontal cross-section of container 1000 along line B-B of FIG. 3. Thus, the cross-section of container 1000 in FIG. 4B includes pressure accommodation areas 410 and vertical ribbed areas 420. As can be seen in FIG. 4B, the sides of the cross-section representing the pressure accommodation areas 410 are slightly curved. This is because FIG. 4B shows a cross-section of pressure accommodation area 410 that includes recess 413.

Figure 4C:
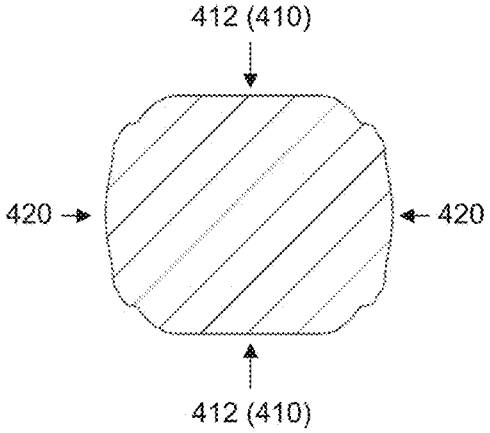
FIG. 4C is a cross-sectional view of the container of FIG. 3 at line C-C.

FIG. 4C is a horizontal cross-section of container 1000 along line C-C of FIG. 3. Thus, the cross-section of container 1000 in FIG. 4C also shows two pressure accommodation areas 410 and two vertical ribbed areas 420. FIG. 4C is different from FIG. 4B in that FIG. 4C shows the cross-section of pressure accommodation areas 410 at the second vacuum panel 412. Thus, contrary to FIG. 4C, the sides of the cross-section representing the pressure accommodation areas 410 are flat and not curved. This is because, in this embodiment, the second vacuum panel 412 is flat.

Figure 4D:
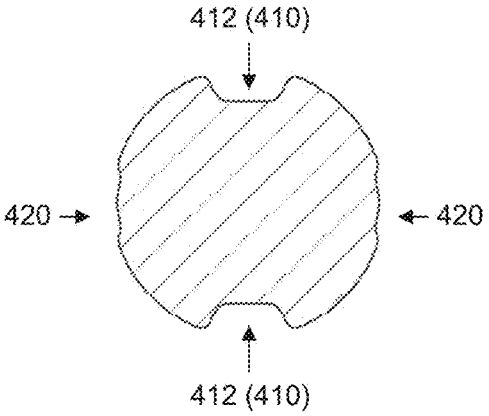
FIG. 4D is a cross-sectional view of the container of FIG. 3 at line D-D.

FIG. 4D is a horizontal cross-section of container 1000 along line D-D of FIG. 3. Thus, the cross-section of container 1000 in FIG. 4D shows pressure accommodation areas 410 and vertical ribbed areas 420. FIG. 4D is different from FIG. 4C in that FIG. 4D shows the cross-section of container 1000 where the body portion 400 transitions into the second vacuum panel 412. The cross-section representing the pressure accommodation area 410 is indented because the second vacuum panel 412 is set back from the remainder of body portion 400.

Figure 4E:
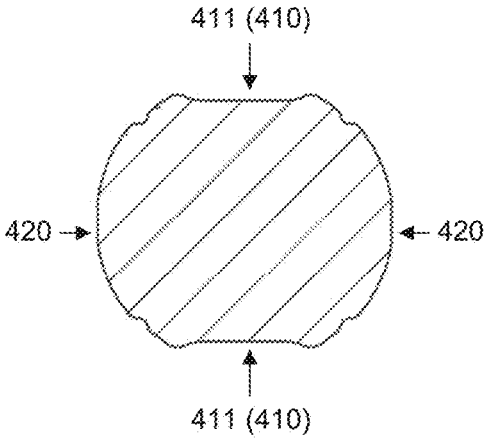
FIG. 4E is a cross-sectional view of the container of FIG. 3 at line E-E.

FIG. 4E is a horizontal cross-section of container 1000 along line E-E of FIG. 3. Thus, the cross-section of container 1000 in FIG. 4E shows pressure accommodation areas 410 and vertical ribbed areas 420. FIG. 4E is different from FIG. 4D in that FIG. 4E shows the transition of the body portion 400 and the first vacuum panel 411. The sides of the cross-section representing the pressure accommodation areas 410 are recessed because the first vacuum panel 411 is set back from the remainder of the body portion 400. FIG. 4E shows a smaller recess than FIG. 4D because, in some embodiments, the body portion close to first vacuum panel 411 is less protruded than the body portion close to second vacuum panel 412. This may also be seen in FIG. 3.

In some embodiments, and as can be seen in FIGS. 4A-4E, body portion 400 has a generally oval circumference across its length. As used herein, "oval" includes a shape with two different perpendicular diameters that act as axes of symmetry, not accounting for minor variation due to surface detail. For example, all of the cross-sections in FIGS. 4A-4E may be considered as being generally oval in shape. In some embodiments, the container 1000 retains a generally oval shape through its deformation, even if the original oval shape is not retained. In some embodiments the retention of a generally oval shape is most prominent at the horizontal cross-section of recess 413. This may be seen in FIGS. 12A-12G, which show the deformation of container 1000 at recess 413, along line B-B of FIG. 3. In some embodiments, and as seen in FIGS. 12A-12G, the original shape is only slightly oval, whereas the oval shape after deformation is more substantial.

Ways in which the pressure accommodation area 410 controls deformation of container 1000 will now be discussed in reference to FIG. 10, FIGS. 11A-11M, FIGS. 12A-12G, FIGS. 14A-14C, and FIGS. 15A-15C.

Figure 11B:
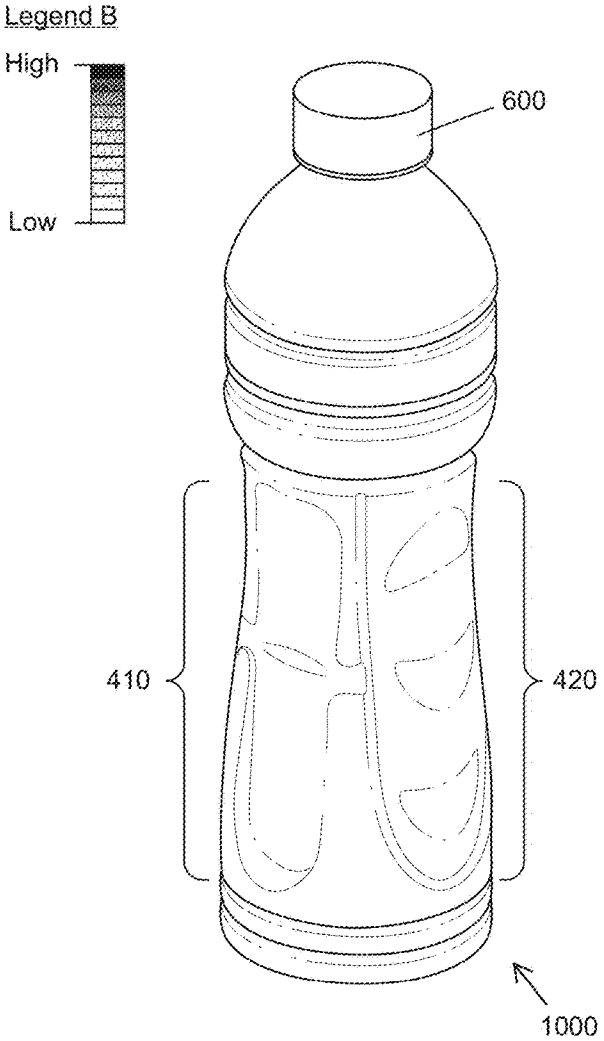
FIG. 11B is a side view of the container of FIG. 11A.

After container 1000 is filled with hot liquid, lid 600 is placed over the neck portion 200, sealing the container from the environment. This is shown in FIG. 11B.

Figure 10:
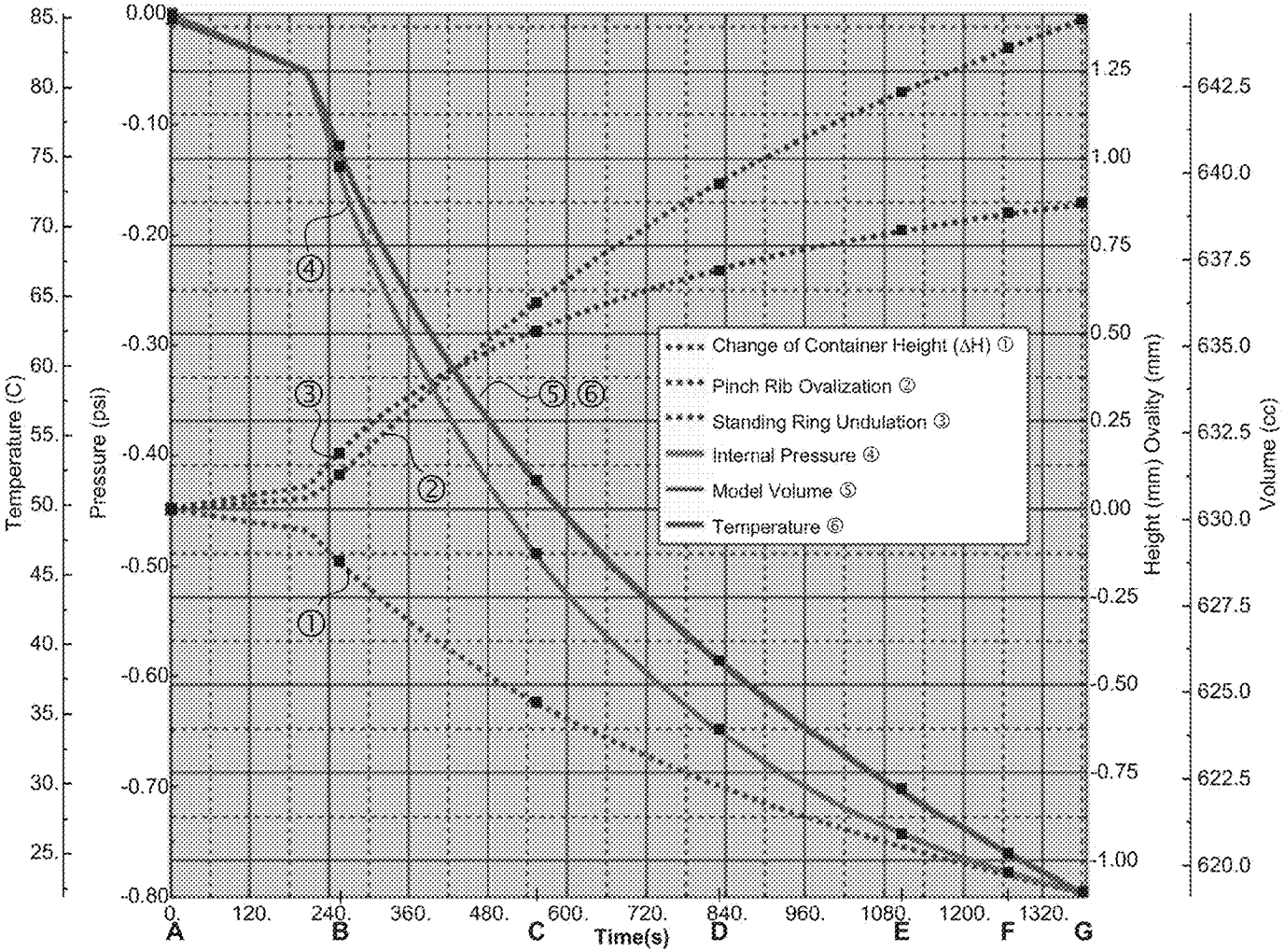
FIG. 10 is a graph showing the change of different variables over time as the temperature of the liquid cools.

FIG. 10 shows a graph detailing the change of six different container characteristics over time during container deformation as the liquid cools: change in container 1000's overall height (H), pinch rib ovalization, standing ring undulation, internal container pressure, container volume, and liquid temperature.

Figure 11A:
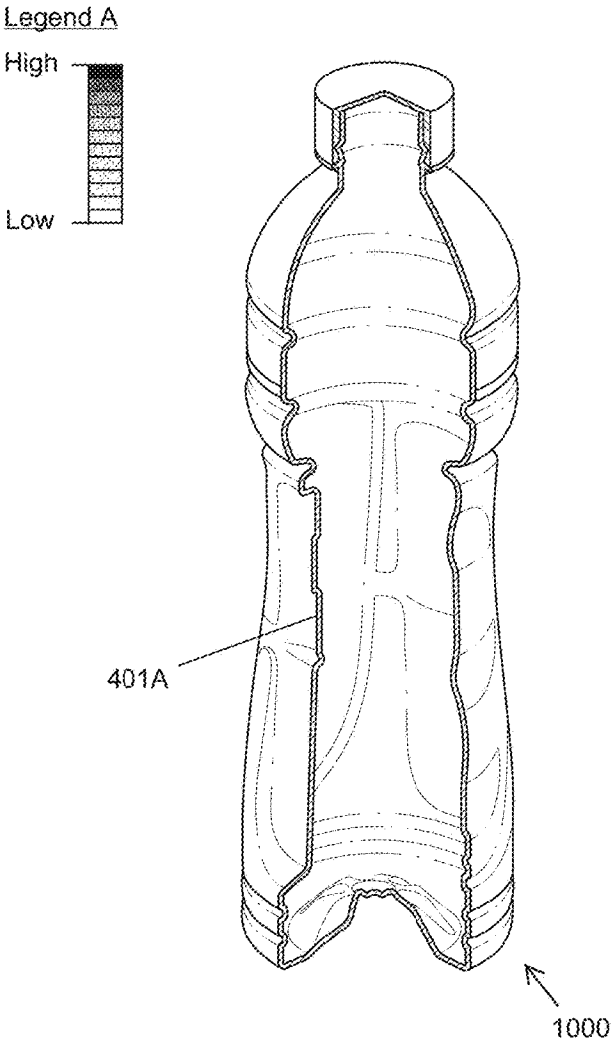
FIG. 11A is a partial view of a container according at point A of the graph in FIG. 10 according to some embodiments.
Figure 11D:
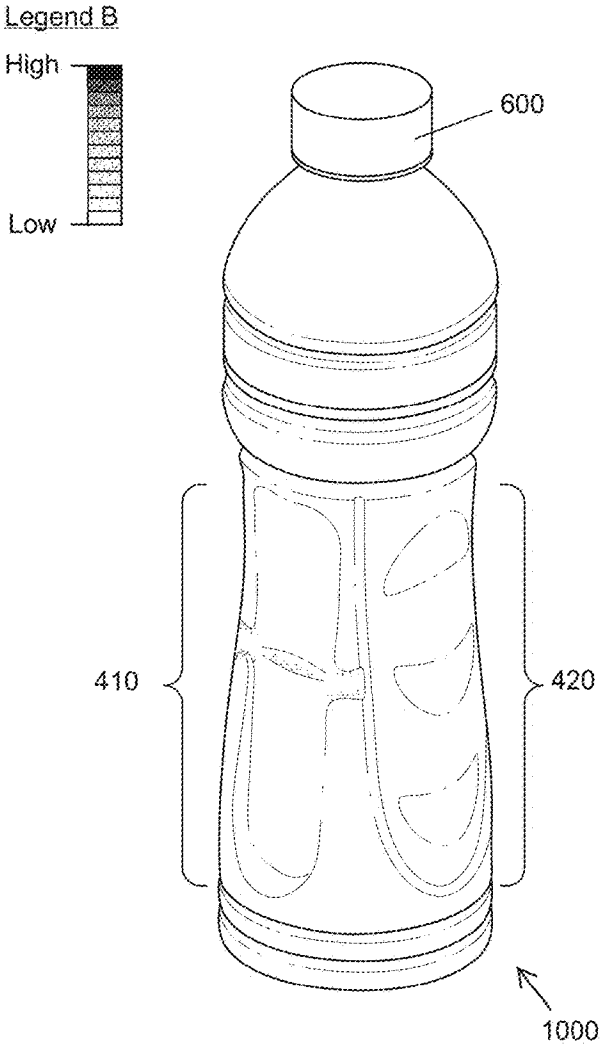
FIG. 11D is a side view of the container of FIG. 11C.
Figure 11C:
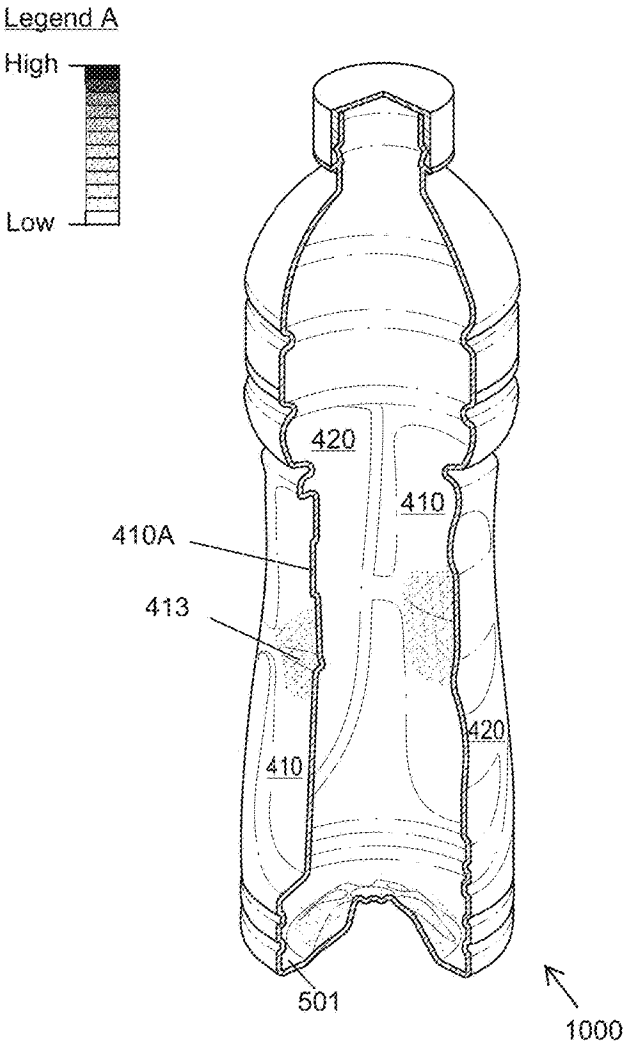
FIG. 11C is a partial view of a container according at point B of the graph in FIG. 10 to some embodiments.
Figure 11F:
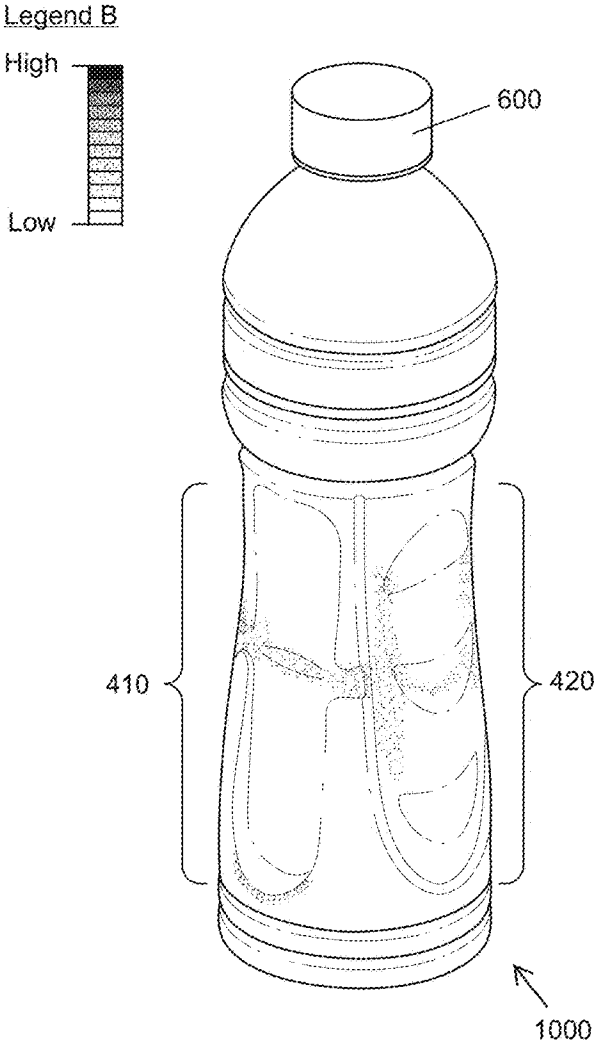
FIG. 11F is a side view of the container of FIG. 11E.
Figure 11E:
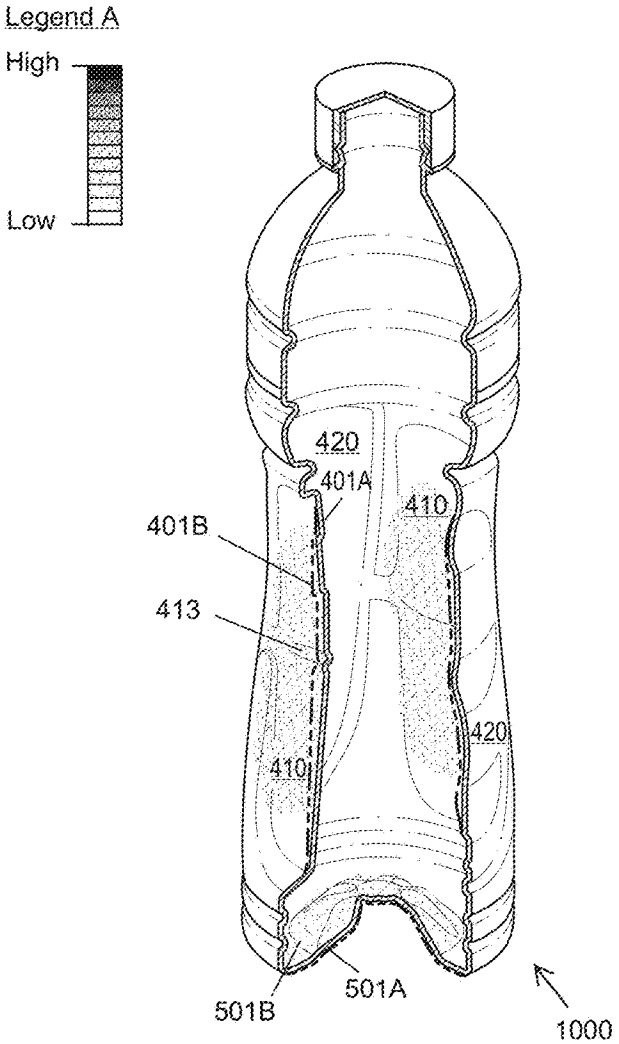
FIG. 11E is a partial view of a container at point C of the graph in FIG. 10 according to some embodiments.
Figure 11H:
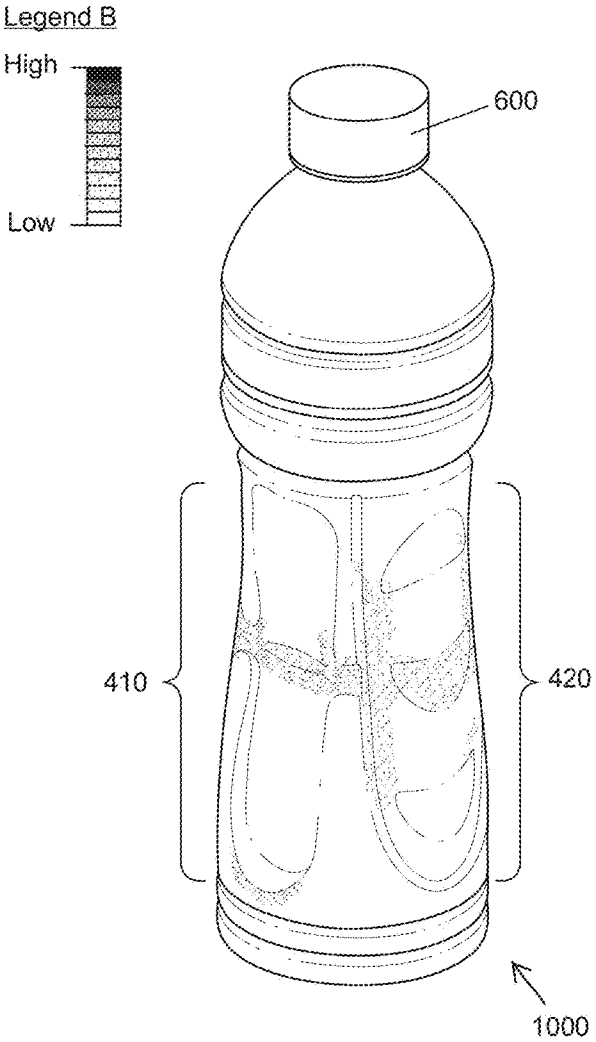
FIG. 11H is a side view of the container of FIG. 11E.
Figure 11G:
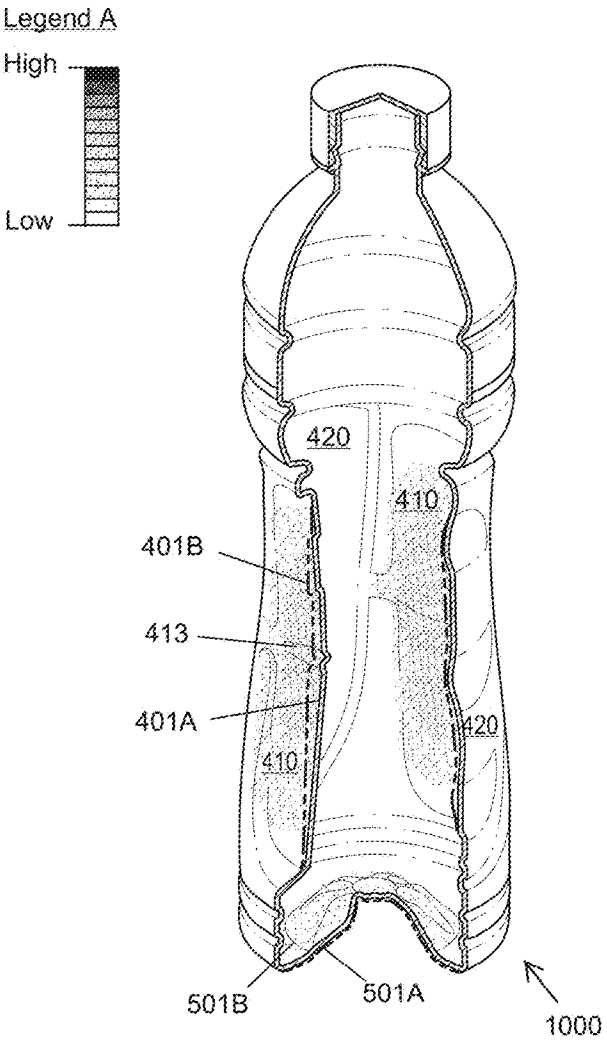
FIG. 11G is a partial view of a container at point D of the graph in FIG. 10 according to some embodiments.
Figure 11J:
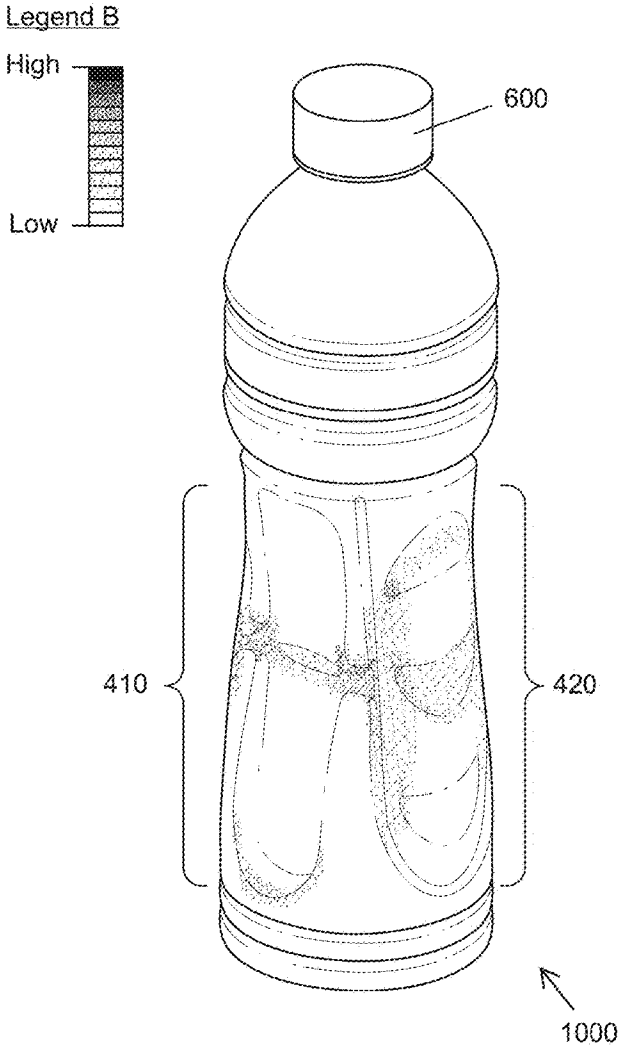
FIG. 11J is a side view of the container of FIG. 11E.
Figure 11I:
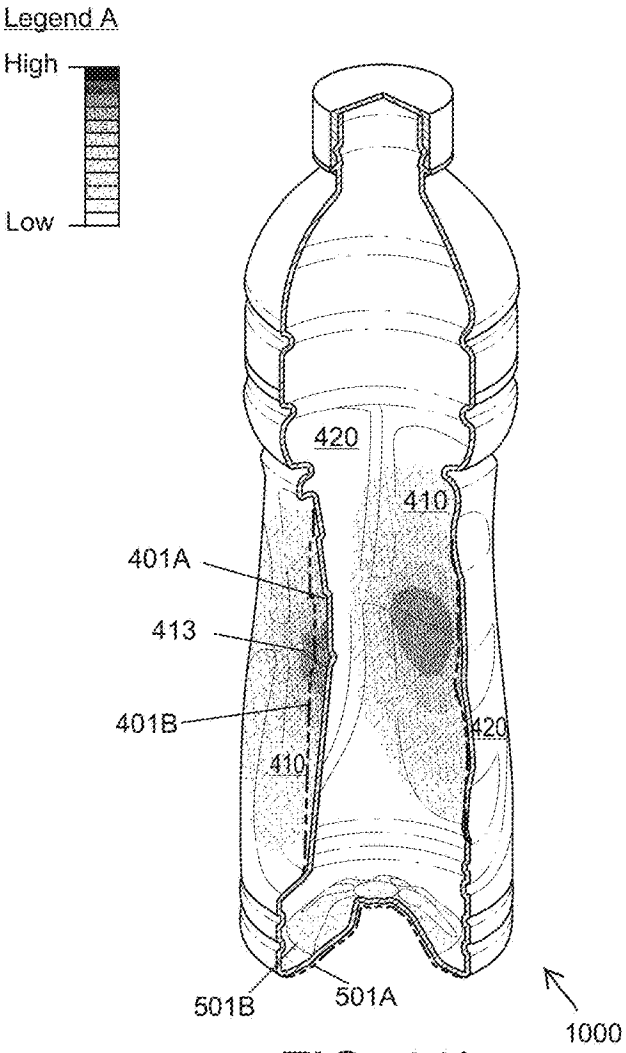
FIG. 11I is a partial view of a container at point E of the graph in FIG. 10 according to some embodiments.
Figure 11L:
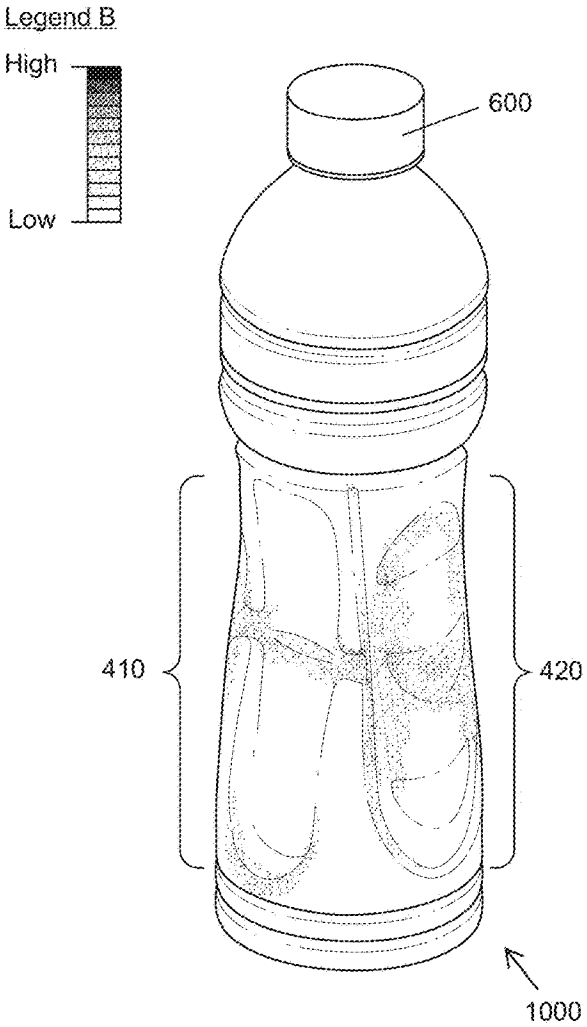
FIG. 11L is a side view of the container of FIG. 11E.
Figure 11K:
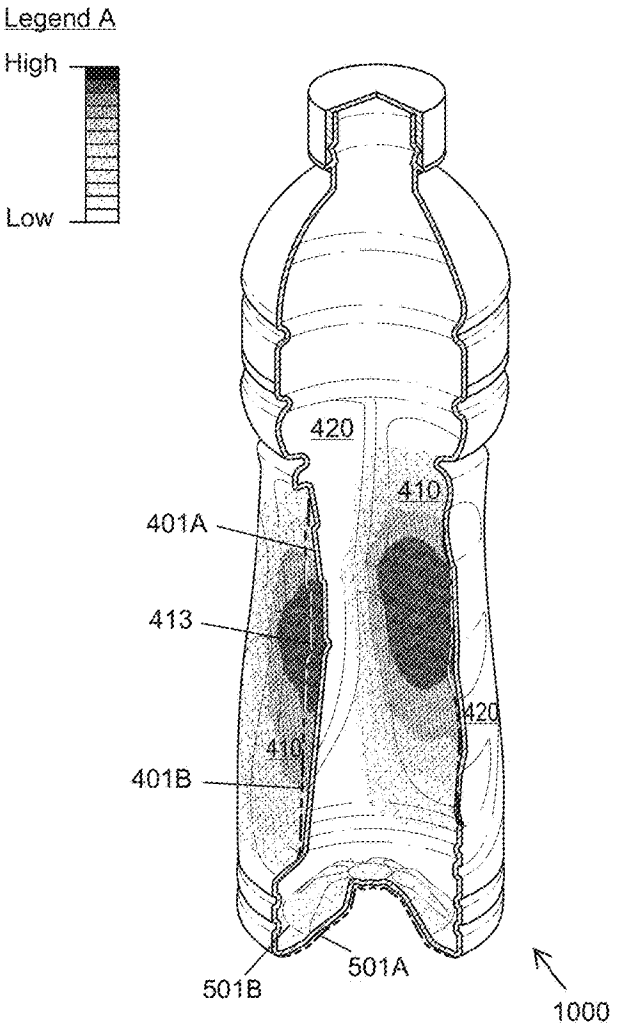
FIG. 11K is a partial view of a container at point F of the graph in FIG. 10 according to some embodiments.
Figure 11N:
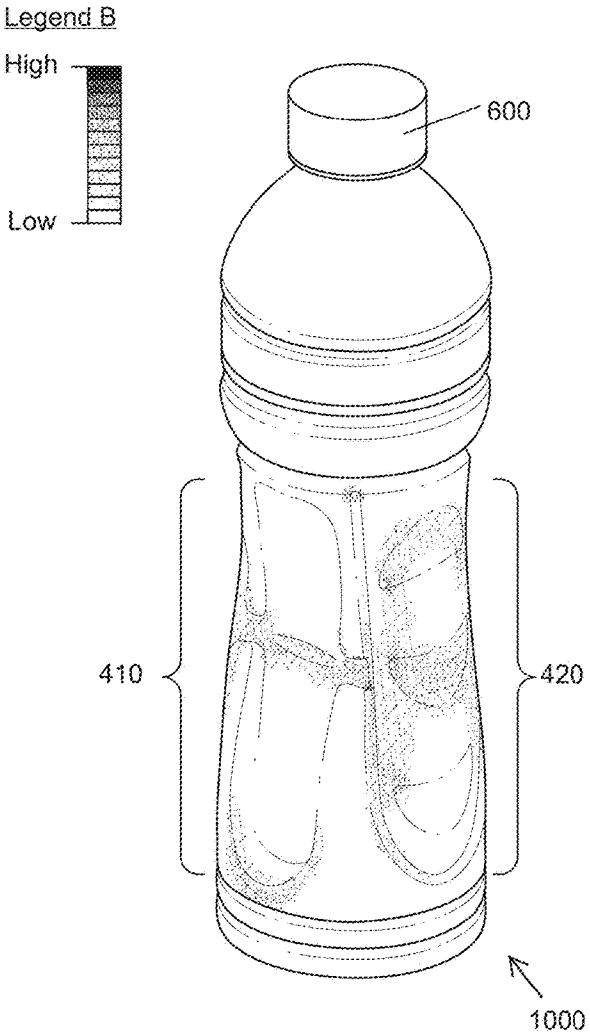
FIG. 11N is a side view of the container of FIG. 11E.
Figure 11M:
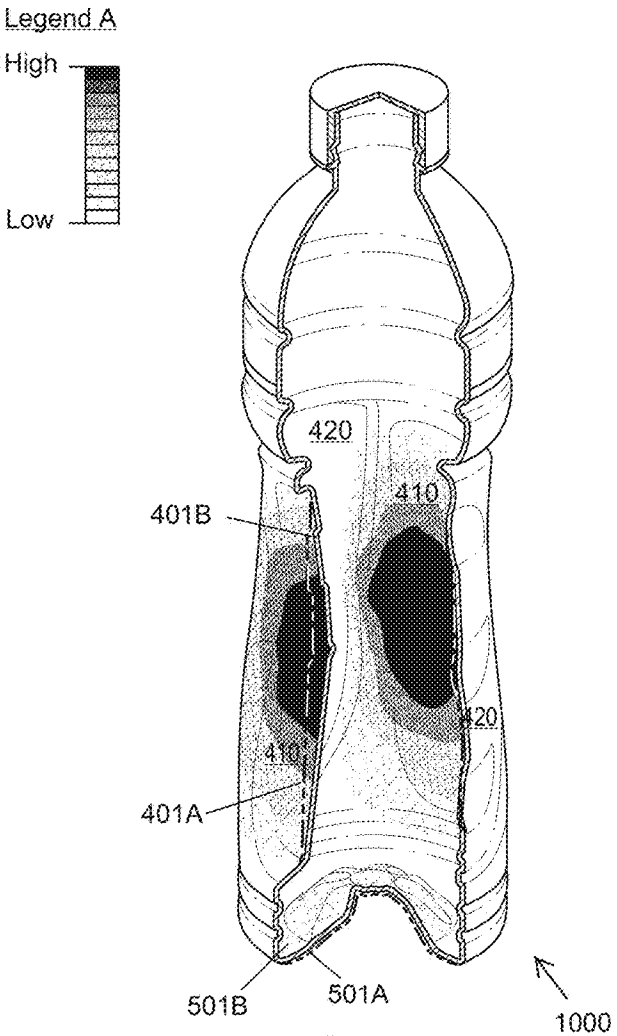
FIG. 11M is a partial view of a container at point G of the graph in FIG. 10 according to some embodiments.

Line 6 represents the change of the liquid temperature over time. Line 4 represents the change in the internal container pressure over time. As shown in FIG. 10, as time passes, the liquid temperature cools and the internal pressure of container 1000 drops. FIG. 10 specifically calls out five sequential time points for reference: time A, time B, time C, time D, time E, time F, and time G. Characteristics at other time points will be apparent from the graph and accompanying explanation. FIGS. 11A-11N show various views of the container at those specific times. FIGS. 11A and 11B show container 1000 at time A. FIGS. 11C and 11D show container 1000 at time B. FIGS. 11E and 11F show container 1000 at time C. FIGS. 11G and 11H show container 1000 at time D. FIGS. 11I and 11J show container 1000 at time E. FIGS. 11K and 11L show container 1000 at time F. FIGS. 11M and 11N show container 1000 at time G.

The stippling in FIGS. 11A, 11C, 11E, 11G, 11I, 11K, and 11M, represent the stresses felt by some portions of the container 1000 relative to other portions of container 1000 at times A, B, C, D, E, F, and G, respectively. More stippling (e.g., appearing darker) represents a relatively higher amount of stress (e.g., von Mises stresses) than less stippling (e.g., appearing lighter or without stippling). The legend A provides a relative reference for relating the depicted stippling to relatively lower and relatively higher stresses felt by one region of the container to the other.

The stippling in FIGS. 11B, 11D, 11F, 11H, 11J, 11L, and 11N, represent the degree of deformation undergone by some portions of the container 1000 relative to other portions of container 1000 at times A, B, C, D, E, F, and G, respectively. More stippling (e.g., appearing darker) represents a relatively greater degree of deformation than less stippling (e.g., appearing lighter or without stippling). The legend B provides a relative reference for relating the depicted stippling to relatively lower and relatively higher degrees of deformation undergone by one region of the container to the other.

At time A, the liquid is still at its elevated temperature and there has been no drop in the internal pressure of container 1000. FIG. 11A shows a partial cross-section of container 1000 at time A. FIG. 11B shows a side view of the container 1000 at time A. At time A the container 1000 is in its original shape and is un-deformed because there is no change in temperature or internal container pressure. Thus, container 1000 shown in FIG. 11A and FIG. 11B do not have any stippled portions as container 1000 is not under any stress or and not deformed at time A.

As the temperature of the liquid cools over time, the internal pressure of container 1000 also drops. As the internal container pressure drops, it becomes lower than the external surrounding pressure, creating a pressure differential (vacuum) that causes stress to the material of container 1000.

For example, at time B in FIG. 10, the temperature of the liquid has cooled from its original temperature at time A and the internal container pressure has dropped from the original pressure at time A. Due to its angled sidewalls, recess 413 is less resistive to stresses. Thus, in response to the drop in in internal container pressure, recess 413 experiences stress before other portions of the container 1000. This is shown in FIG. 11C with the stippled region being only at and immediately around recess 413. Additionally, the pressure accommodation area 410 begins to slightly flex at recess 413 towards an interior of the container. This is shown in FIG. 11D as the lightly stippled area at recess 413.

As the temperature of the liquid further cools and the internal pressure of container 1000 further drops, for example at time C, the first and second vacuum panels 411 and 412 start to experience stress as well. This is shown in FIG. 11E. As compared to FIG. 11C, the stippled area originally contained at recess 413 has spread to the first vacuum panel 411 and the second vacuum panel 412. As shown in FIG. 11E, recess 413 further flexes towards the interior of container 1000. This flexing causes the flexing of the first vacuum panel 411 and the second vacuum panel 412 towards the interior of the container 1000. As compared to FIG. 11D, the first vacuum panel 411 and the second vacuum panel 412 in FIG. 11F are further angled. The flexing of recess 413, first vacuum panel 411, and second vacuum panel 412 causes the pressure accommodation area to flex towards the interior of container 1000. This is also shown in FIG. 11E by the line 401A showing the original profile of the pressure accommodation area line and 401B, showing the deflection profile of the pressure accommodation area.

Times D, E, F, and G involve progressively cooler liquid temperatures and progressively decreased internal container pressures. FIGS. 11G and 11H correspond to time D in FIG. 10. FIGS. 11I and 11J correspond to time E in FIG. 10. FIGS. 11K and 11L correspond to time F in FIG. 10. FIGS. 11M and 11N correspond to time G in FIG. 10.

Generally, FIGS. 11A, 11C, 11E, 11G, 11I, 11K, and 11N show that the portion of container 1000 that experiences stress first is recess 413. The stress then spreads to the first vacuum panel 411 and the second vacuum panel 412. These figures also show that the stresses felt by the container 1000 during the cooling process are mostly concentrated in pressure accommodation areas 410. In some embodiments, greater than 50% of the stresses felt by the container 1000 during the cooling process are concentrated in pressure accommodation areas 410. In some embodiments, greater than 75% of the stresses are concentrated in pressure accommodation areas 410. In some embodiments, greater than 90% of the stresses are concentrated in pressure accommodation areas 410.

FIGS. 11B, 11D, 11F, 11H, 11J, 11L, and 11M show that recess 413 starts to flex towards an interior of the container 1000 before any other portion of container 1000. After the recess 413 flexes, the first vacuum panel 411 and the second vacuum panel 412 start to flex towards an interior of the container 1000. FIGS. 11B, 11D, 11F, 11H, 11J, 11L, and 11M also show that the shape of the other portions of container 1000, such as neck portion 200, shoulder portion 300, and base portion 500, do not deform as much relative to the deformation experienced by the body portion 400. In some embodiments the shape of the other portions of container 1000, such as neck portion 200, shoulder portion 300, and base portion 500, do not deform at all (or not appreciably) relative to the deformation experienced by the body portion 400. In some embodiments, in the body portion 400, the horizontal cross-section that changes the most relative to all the other horizontal cross-sections of the body portion 400 is a cross-section taken at recess 413. This change is described in more detail later in relation to FIGS. 12A-12G.

Figure 8:
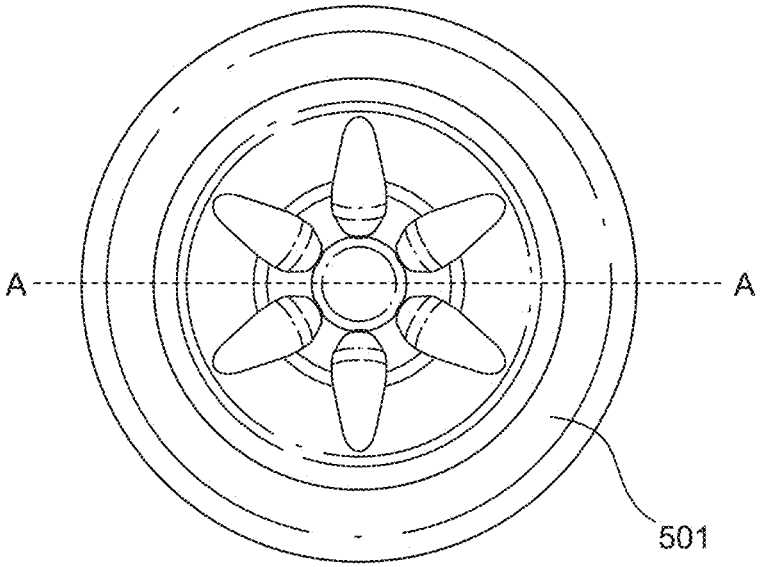
FIG. 8 is a bottom view of a container according to some embodiments.
Figure 9:
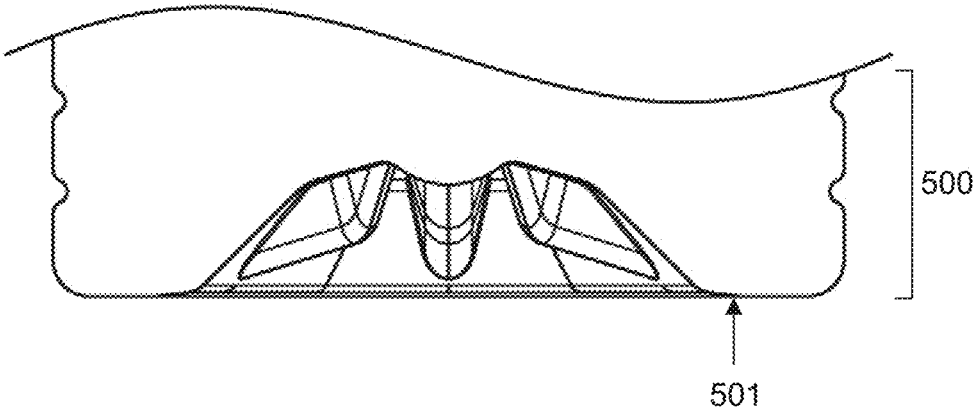
FIG. 9 is a cross-sectional view of the container of FIG. 8 at line A-A.

FIG. 10 also shows line 3, which details the undulation of the standing ring in millimeters. Base portion 500 has standing ring 501, as shown in FIGS. 2, 8, and 9. Standing ring 501 is the bottom surface of the container 1000 upon which container 1000 sits. Line 3 in FIG. 10 shows that, as the internal pressure of container 1000 drops, the standing ring 501 also slightly flexes in towards the interior of the container 1000.

The flex of standing ring 501 towards the interior of container 1000 is shown in FIGS. 11E, 11G, 11I, 11K, and 11M. Line 501A in those figures shows the placement of the original standing ring and line 501B shows the flexing of the standing ring in response to the change of internal container pressure. The amount of flex experienced by the standing ring 501 is small relative to the flex experienced by the pressure accommodation area. The difference of flexing between the standing ring 501 and the pressure accommodation area 410 may be gauged by comparing the change between lines 401A and 401B, and the change between lines 501A and 501B. Because the pressure accommodation area 410 is designed to concentrate the stresses only to that area of container 1000, the other portions of container 1000 do not experience substantial stress or deformation. Thus, due to the pressure accommodation areas, the change in shape of the other portions due to a change in internal container pressure, including the standing ring 501, is relatively small. Thus, the deformation of container 1000 is mostly contained to body portion 400.

In some embodiments, the small deformation of other portions of container 1000 compared to the deformation of body portion 400 may be quantified by determining how much that portion has flexed in towards an interior of container 1000 compared to how much recess 413 of body portion 400 has flexed. For example, in some embodiments, the amount of flex (e.g., deformation displacement) experienced by standing ring 501 after deformation is, at most, 10% of the amount of flex experienced by body portion 400 at recess 413 after deformation. In some embodiments, the amount of flex experienced by standing ring 501 is at most 5% of the amount of flex experienced by the vacuum accommodation area at recess 413. In some embodiments, the amount of flex experienced by standing ring 501 is at most 2% of the amount of flex experienced by the pressure accommodation areas at recess 413.

In some embodiments, the deformation displacements may be compared by determining what percentage of container 1000's volume reduction is contributed to the deformation of body portion 400.

For example, when the liquid cools, its volume is reduced (e.g., by 3-5%). Thus, in some embodiments, the flexing of the body portion 400 decreases container 1000's initial volume by 3%. In some embodiments, the initial volume is decreased by 5%. In some embodiments, at least 85% of the decrease in container 1000's initial volume is due to the deformation of body portion 400. In some embodiments at least 90% of the decrease in initial container volume is because of deformation of body portion 400. In some embodiments, at least 95% of the decrease in initial container volume is due to deformation of body portion 400.

In some embodiments, the structure of the recess and its connection to the first vacuum panel 411 and the second vacuum panel 412 initiates and contributes to the flexing of the first vacuum panel 411 and the second vacuum panel 412. For example, in some embodiments, the recess 413 acts as a living hinge connecting the first vacuum panel 411 and the second vacuum panel 412. Thus, as the living hinge flexes in towards the interior of the container 1000, it gradually pulls the first vacuum panel 411 and the second vacuum panel 412 in towards an interior of container 1000. In some embodiments, the living hinge has two sidewalls 414A and 414B forming an angle 415. As the hinge flexes inwards, the angle 415 gets progressively smaller. This is shown in FIGS. 15A-15C.

FIGS. 14A-FIG. 14C schematically show an inward flexing of first vacuum panel 411 and second vacuum panel 412. In FIG. 14A, the first vacuum panel and the second vacuum panel are in their original shape. They form an angle 430 at the recess 413. As the first vacuum panel 411 and the second vacuum panel 412 flex in towards the interior of the container 1000 in response to an increasing change in the internal pressure, the angle 430 formed by the first vacuum panel 411 and the second vacuum panel 412 at recess 413 becomes progressively smaller. It is noted that FIGS. 14A-14C are only a schematic representation and that the angle change as shown in these figures is exaggerated for clarity. In some embodiments, since deformation of pressure accommodation area 410 is concentrated at recess 413, first vacuum panel 411 disposed above recess 413 undergoes greater deformation at its lower end (e.g., a degree of deformation of first vacuum panel 411 decreases in an upward direction from recess 413). Similarly, second vacuum panel 412 disposed below recess 413 undergoes greater deformation at its upper end (e.g., a degree of deformation of second vacuum panel 412 decreases in a downward direction from recess 413).

In some embodiments, and as shown in FIG. 14A, the first vacuum panel 411 and the second vacuum panel 412 are co-planar to one another prior to flexing. As the panels flex in towards the interior of the container 1000 and form a progressively smaller angle at the recess, first vacuum panel 411 and second vacuum panel 412 move out of plane and are no longer co-planar to each other. In some embodiments, at least one of the vacuum panel 411 or 412 remains flat while flexing and is flat after flexing. Maintaining a flat area in this way may promote more efficient container handling during a labeling process.

Additionally, in an embodiment, the vertical ribbed areas 420 may flex outward as recess 413, first vacuum panel 411, and second vacuum panel 412 flex in towards an interior of the container 1000.

Figure 12B:
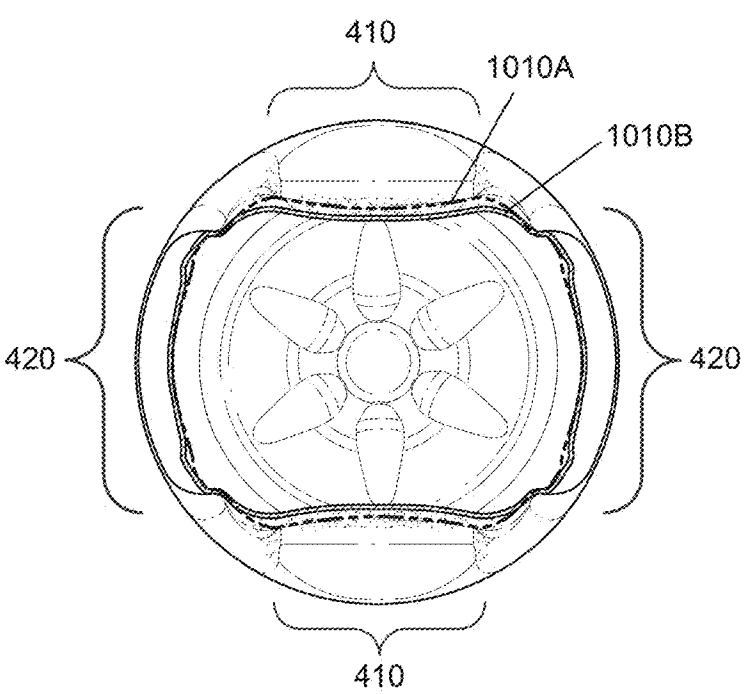
FIG. 12B shows changes to the cross-sectional view of FIG. 12A while flexing.
Figure 12A:
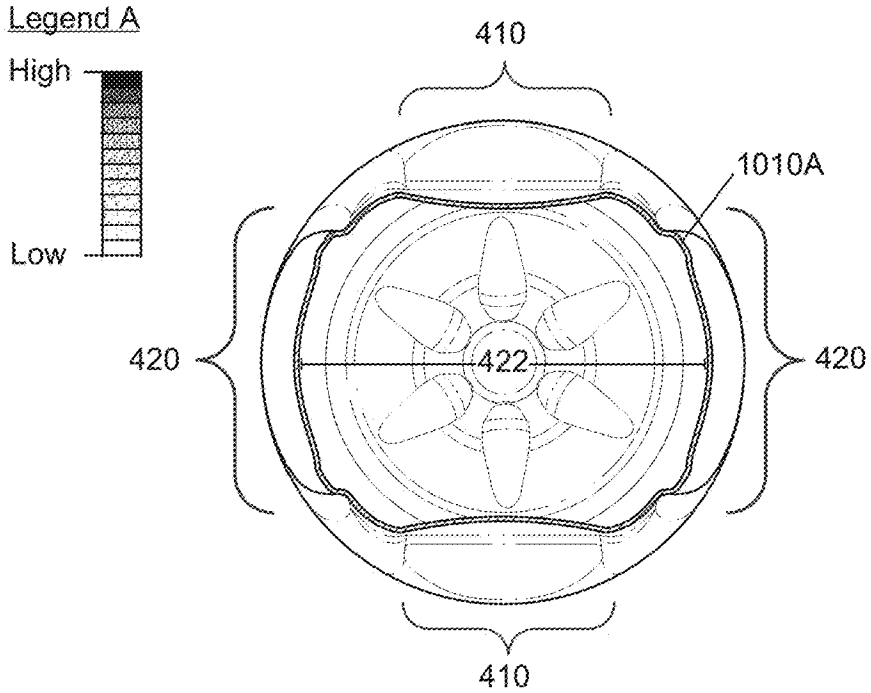
FIG. 12A is a cross-sectional view of a container at the recess before flexing according to some embodiments.
Figures 12E, 12F, 12G:
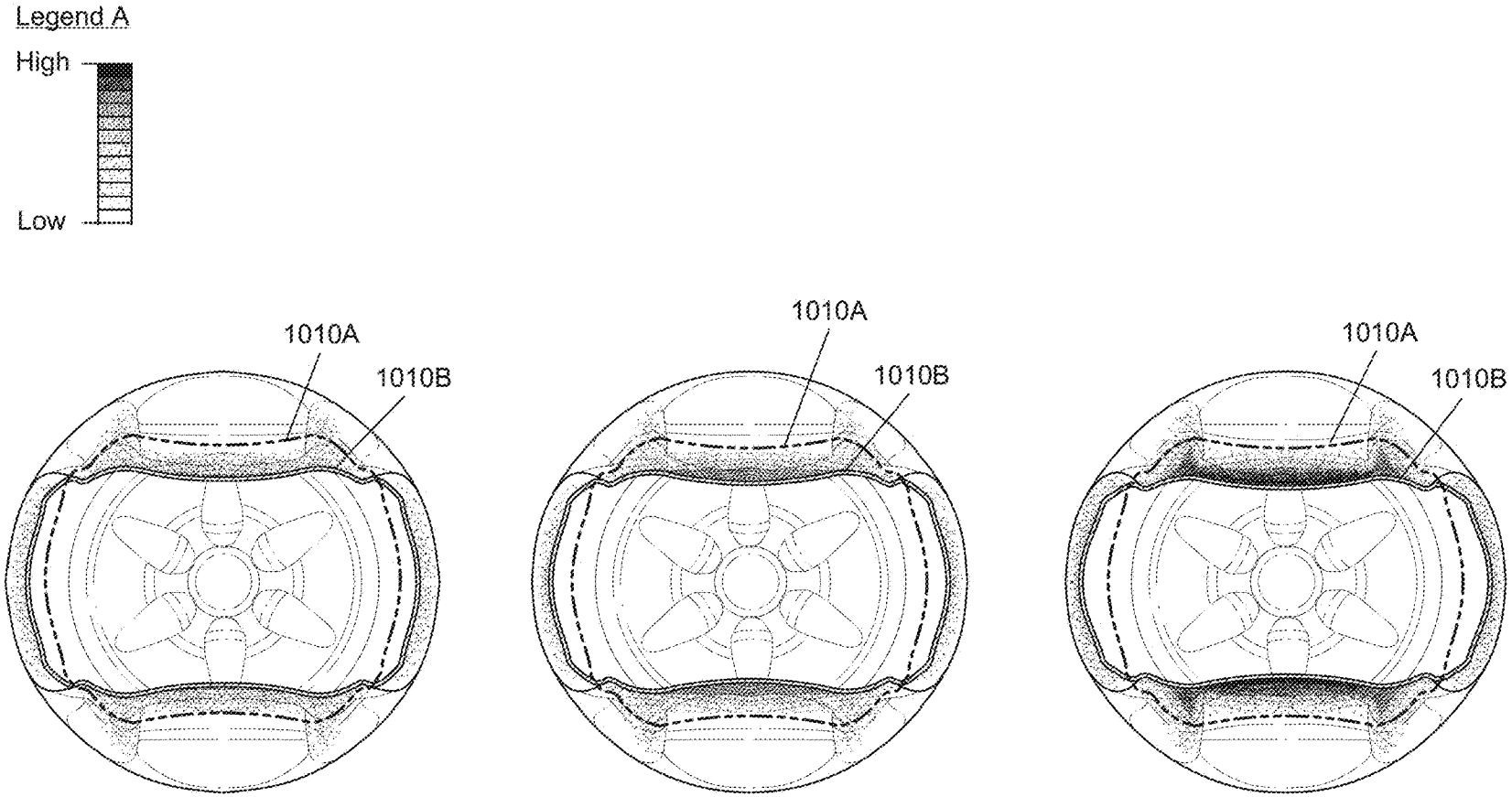
FIG. 12E shows changes to the cross-sectional view of FIG. 12A while flexing.
FIG. 12F shows changes to the cross-sectional view of FIG. 12A while flexing.
FIG. 12G shows changes to the cross-sectional view of FIG. 12A while flexing.

FIGS. 12A-12F show a cross-section of container 1000 at the recess 413 before flexing (FIG. 12A), during flexing (FIGS. 12B-12F), and after flexing (FIG. 12G). The stippling in FIGS. 12A-12G, represent the stresses felt by some portions of the container 1000 relative to other portions of container 1000 at time A. More stippling (e.g., appearing darker) represents a relatively higher amount of stress (e.g., von Mises stresses) than less stippling (e.g., appearing lighter or without stippling). The legend A provides a relative reference for relating the depicted stippling to relatively lower and relatively higher stresses felt by one region of the container to the other.

For clarity, pressure accommodation areas 410 and vertical ribbed areas 420 are only labeled in FIGS. 12A-12B and unlabeled in FIGS. 12D-12F. Similar to FIGS. 11A, 11C, 11E, 11G, 11I, 11K, and 11M, legend A is provided that shows the relative stresses experienced by the different sections of the cross-section.

As shown in FIG. 12A, the body portion 400 has a cross-sectional oval shape 1010A at recess 413 before flexing. As the body portion 400 flexes, the cross-sectional shape 101A changes to 1010B. This change includes the vertical ribbed areas 420 flexing outward, increasing diameter 422. As can be seen by FIGS. 12A-12G, the rate that the pressure accommodation areas 410 flex in is faster than the rate that the vertical ribbed areas 420 flex out. In other words, at any given time when container 1000 is experiencing deformation, the inward deformation of pressure accommodation areas 410 will be greater than the outward deformation of ribbed areas 420. Thus, on some embodiments, and as seen in FIGS. 12A-12G, the original shape of body portion 400 at recess 413 is only slightly oval, whereas the oval shape after deformation of body portion 400 at recess 413 is more substantial. This container characteristic is represented by line 2 (labeled "pinch rib ovalization") in FIG. 10, which details the change in diameter 422 between the two vertical ribbed areas 420 as shown in FIG. 12A. For clarity, diameter 422 is only labeled in FIG. 12A.

In some embodiments, container 1000 may return to its original shape when the lid 600 is removed from neck portion 200 and the seal is released. This is due to the characteristics of the pressure accommodation area 410. Not only is pressure accommodation area 410 easily deflectable, but it does not retain its deflected shape. Pressure accommodation area 410 remains flexible after flexing so that it may flex outwards once container 1000 is opened. In some embodiments, pressure accommodation area 410 may be comprised of a thermoplastic polymer resin, like PET (polyethylene terephthalate). Other suitable thermoplastic resins are also envisioned, like bioplastics such as PEF (polyethylene fluranoate).

Figure 13:
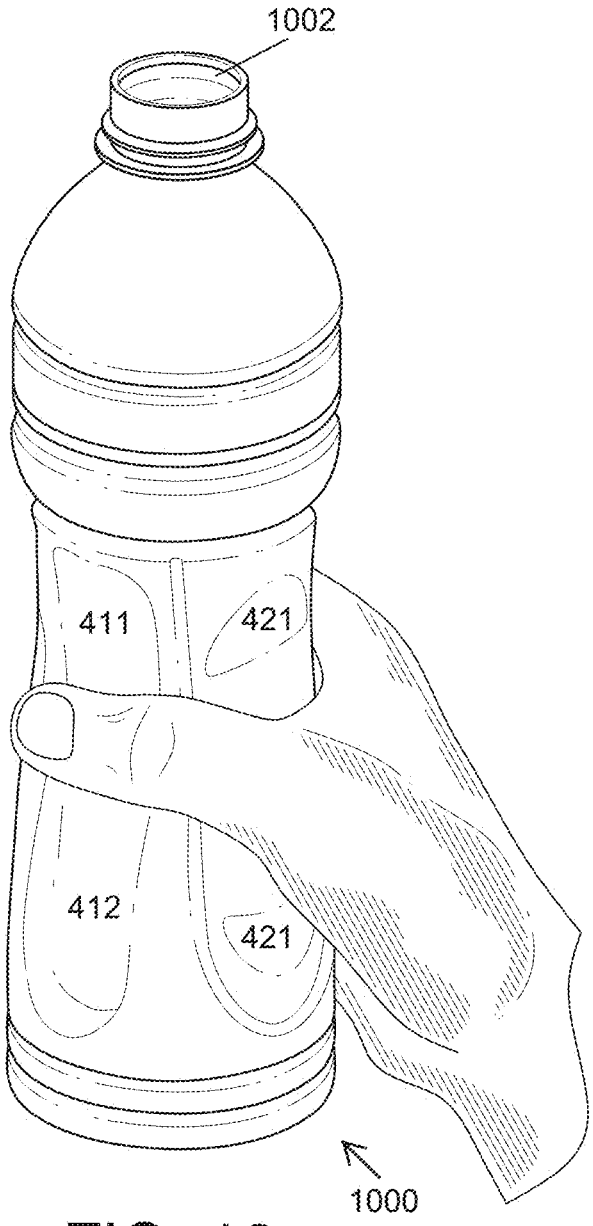
FIG. 13 is a side view of a container being gripped by a consumer according to some embodiments.

In some embodiments, the pressure accommodation areas 410 may also be shaped to allow gripping and squeezing of the container by a consumer. For example, in some embodiments, recess 413 is shaped as a groove to accommodate a consumer's thumb. In embodiments with two pressure accommodation areas 410 where the second pressure accommodation area diametrically opposes the first, the second pressure accommodation area 410 also has recess 413 that is shaped as a groove to accommodate the consumer's middle finger or forefinger. In the same manner that recess 413 is easily deflected due to a change in internal pressure, it is also easily deflected due to a change in an applied external pressure. For example, as seen in FIG. 13, a consumer may grip container 1000 at the recess 413 in the middle of the pressure accommodation areas 410 between the consumer's thumb and forefinger. With a small squeeze, an applied external pressure is placed on the bottle at these areas. Because these areas easily deflect upon stress, they easily flex towards an interior container 1000, allowing for the amount of liquid to be dispensed to be large relative to the pressure that is applied by the consumer.

The present invention has been described above with the aid of functional building blocks illustrating the implementation of specified functions and relationships thereof. The boundaries of these functional building blocks have been defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

Further, references herein to "some embodiments," "one embodiment," "an embodiment," "an example embodiment," or similar phrases, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein.

What is claimed is:

1. A container comprising:

a neck portion defining a container opening;

a shoulder portion connected to the neck portion;

a body portion extending from the shoulder portion to a base portion, wherein the body portion comprises two pressure accommodation areas and two vertical ribbed areas, wherein each pressure accommodation area includes a first flat panel, a second flat panel, and a groove positioned on an outer surface of the body portion between the first flat panel and the second flat panel and connecting the first flat panel and the second flat panel, wherein the grooves move in towards an interior of the body in response to a decrease in internal container pressure, and wherein a horizontal cross section of each of the first flat panel and the second flat panel, respectively, is straight before the decrease in internal pressure and during the decrease in internal pressure as the recess moves towards the interior of the container.

2. The container of claim 1, wherein the body portion has an oval cross-section and the groove of one pressure accommodation area is disposed diametrically opposite the groove of the other pressure accommodation area.

3. The container of claim 1, wherein the decrease in internal container pressure is caused by cooling of a liquid contained within the container.

4. The container of claim 1, wherein the container includes no more than two of the pressure accommodation areas.

5. The container of claim 1, wherein the body portion further comprises a scalloped region extending circumferentially adjacent to the flat upper vacuum panel, the flat lower vacuum panel, and the recess and wherein the scalloped region flexes outwardly in response to the decrease in the internal container pressure.

6. A container for storing a liquid filled in a hot state and then sealed, the container comprising:

a neck portion defining a container opening;

a shoulder portion connected to the neck portion;

a pressure accommodation area coupled to the shoulder portion, wherein the pressure accommodation area comprises a first flat panel, a second flat panel, and a valley positioned between the first flat panel and the second flat panel, wherein, when the container is sealed, the valley of the pressure accommodation area is configured to move towards an interior of the container, wherein a horizontal cross section of each of the first flat panel and the second flat panel, respectively, is straight both before the decrease in internal container pressure and during the decrease in internal container pressure as the valley moves towards the interior of the container, and wherein, when the seal is released, the pressure accommodation area is configured to return to its original shape.

7. The container of claim 6, wherein the movement of the valley towards the interior of the container is initiated by cooling of the liquid.

8. A container comprising:

a body portion including a flat upper vacuum panel, a flat lower vacuum panel, and a recess positioned on an outer surface of the body portion between the flat upper vacuum panel and the flat lower vacuum panel and coupling the flat upper vacuum panel and the flat lower vacuum panel, wherein, in response to a decrease in internal container pressure, the recess moves towards an interior of the container, and wherein the flat upper vacuum panel and the flat lower vacuum panel form an angle with respect to each other when viewing a vertical cross section through the flat upper vacuum panel, the flat lower vacuum panel and the recess, and wherein the angle decreases in response to the decrease in internal container pressure, wherein the recess is a living hinge, and wherein a horizontal cross section of each of the flat upper vacuum panel and the flat lower vacuum panel, respectively, is straight both before the decrease in internal container pressure and during the decrease in the internal container pressure as the recess moves towards the interior of the container.

9. The container of claim 8, wherein the hinge comprises two connecting sidewalls forming a hinge angle, wherein the hinge angle decreases as the recess moves towards an interior of the container.

10. The container of claim 8, wherein the flat upper vacuum panel and flat lower vacuum panel are co-planar prior to the recess moving towards the interior of the container.

11. The container of claim 8, wherein the flat upper vacuum panel and the flat lower vacuum panel together have a height that is at least 30% of a total height of the container.

12. The container of claim 8, wherein at least one of the flat upper vacuum panel and the flat lower vacuum panel has a height that is at least 15% of a total height of the container.

13. The container of claim 8, wherein the container has an initial volume, and wherein the movement of the recess towards the interior of the container, decreases the initial volume by 3%.

14. The container of claim 13, wherein the movement of the recess towards the interior of the container, decreases the initial volume by 5%.

15. The container of claim 8, wherein the recess comprises a valley with an angled sidewall.

16. The container of claim 8, wherein the body portion has an oval cross-section.

17. The container of claim 8, further comprising a shoulder portion connected to the body portion, wherein the shoulder portion has a cross-sectional circumference that is greater than a cross-sectional circumference of the body portion.

18. The container of claim 8, further comprising:

a neck portion with a cross-sectional circumference;

a shoulder portion with a cross-sectional circumference, wherein the shoulder portion is connected to the neck portion; and a base portion with a cross-sectional circumference, wherein the body portion extends from the shoulder portion to the base portion, wherein a cross-sectional circumference of the body portion at the recess changes more relative to the other cross-sectional circumferences in response to the decrease in internal container pressure.

19. The container of claim 18, wherein the flat upper vacuum panel and the flat lower vacuum panel are co-planar before the recess moves towards the interior of the container.

20. The container of claim 8, wherein the body portion further comprises a scalloped region extending circumferentially adjacent to the flat upper vacuum panel, the flat lower vacuum panel, and the recess.

21. The container of claim 20, wherein the scalloped region flexes outwardly in response to the decrease in internal container pressure.

22. The container of claim 8, wherein the container is a bottle.

* * * * *